US012758039B2

(12) United States Patent
Johnston et al.

(10) Patent No.: US 12,758,039 B2
(45) Date of Patent: Oct. 13, 2026

(54) INTEGRATED BED SHEET SYSTEM AND DUVET SYSTEM AND FOLDING BOARD

(71) Applicant: TRUUCE INC., Hunt Valley, MD (US)

(72) Inventors: Nancy S. Johnston, Hunt Valley, MD (US); Kerry Roberts, Hunt Valley, MD (US)

(73) Assignee: Truuce Inc., Hunt Valley, MD (US)

( * ) Notice: Subject to any disclaimer, the term of this patent is extended or adjusted under 35 U.S.C. 154(b) by 72 days.

(21) Appl. No.: 18/944,171

(22) Filed: Nov. 12, 2024

(65) Prior Publication Data

US 2025/0151933 A1 May 15, 2025

Related U.S. Application Data

(60) Provisional application No. 63/547,994, filed on Nov. 10, 2023.

(51) Int. Cl.
*A47G 9/02* (2006.01)
*A47G 9/04* (2006.01)

(52) U.S. Cl.
CPC ..... *A47G 9/0246* (2013.01); *A47G 9/0261* (2013.01); *A47G 9/04* (2013.01); *A47G 2009/0276* (2013.01)

(58) Field of Classification Search
None
See application file for complete search history.

(56) References Cited

U.S. PATENT DOCUMENTS

2012/0074021 A1* 3/2012 Ravary ..... B65D 75/52 206/494
2012/0260424 A1* 10/2012 Agarwall ..... A47G 9/0246 493/393
2022/0248865 A1* 8/2022 Zhou ..... A47G 9/0238
2023/0200572 A1* 6/2023 Ginberg ..... A47G 9/0261 5/482
2023/0240455 A1* 8/2023 Sinn ..... A47G 9/0246 5/496

FOREIGN PATENT DOCUMENTS

GB 2440822 A * 2/2008 ..... A47G 9/08

* cited by examiner

*Primary Examiner* — Adam C Ortiz
(74) *Attorney, Agent, or Firm* — Marc W. Butler; Miles & Stockbridge P.C.

(57) ABSTRACT

A bed sheet system and method of assembly includes a fitted sheet configured to fit over a mattress and a top sheet is configured to fit over the fitted sheet, wherein the top sheet is connected to the fitted sheet via an open-ended zipper assembly. A duvet cover may be configured to connect to the top sheet along another open-ended zipper assembly thereby forming an insert area for receiving a duvet insert. A duvet insert is disposed between the top sheet and duvet cover in a final assembly.

11 Claims, 24 Drawing Sheets

INTEGRATED BED SHEET SYSTEM AND DUVET SYSTEM AND FOLDING BOARD

CROSS-REFERENCE TO RELATED APPLICATIONS

This application claims benefit of priority of U.S. Provisional Patent Application No. 63/547,994, entitled "INTEGRATED BED SHEET SYSTEM, & INTEGRATED BED SHEET & DUVET SYSTEM WITH OPTIONAL FOLDING BOARD" filed Nov. 10, 2023. The entire contents and disclosures of these patent applications are incorporated herein by reference in their entirety.

BACKGROUND

Field of the Invention

The inventions disclosed herein generally relate to bedding, bed sheets, duvet covers, and an apparatus used to fold these bedding systems as well as traditional sheet sets.

Background of the Invention

The typical bed sheet set consists of a fitted sheet, or bottom layer that covers the mattress, and a top sheet, or flat sheet or top layer, that both correspond to the size of the mattress to be covered. It is readily appreciated that the most common sizes of mattresses sold on the market today are typically twin, full, queen, king, among others. The inventions described herein will generally correspond to a queen mattress. The measurements discussed should be adjusted accordingly for the corresponding size of mattress.

Purposes of bed sheets includes covering mattresses for hygienic and comfort purposes while also covering those that are in between the sheet set for warmth, hygiene, and general coverage in order to not be exposed to the elements.

While traditional sheets fit the corresponding mattress sizes for the most part, the movement of the individuals between the sheets and the different depths of mattresses causes the sheets to move and be displaced during use. This may cause frustration and interrupt a good night's sleep. Furthermore, the design of the traditional duvet cover can be challenging to put on, stay in place, remove and launder.

Thus, a need exists for providing new bedding systems and corresponding folding board to solve the age old problems of: displaced sheets during use; preventing the sheets from untucking or coming off the mattress; making it easier for people using the sheet and duvet system to put them on the mattress and putting a duvet cover on the duvet insert (or duvet blanket as it is sometimes referred to); keeping the sheets and duvet in place during use; repositioning the sheets and duvet back to their original position more efficiently (i.e., in common terms making the bed); and to laundering, folding and replacing them on the bed easily and without frustration.

SUMMARY

According to first broad aspect, the present disclosure provides a bed sheet system comprising: a fitted sheet configured to fit over a mattress, wherein the fitted sheet comprises a first connecting panel; a top sheet configured to fit over the fitted sheet, wherein the top sheet comprises a second connecting panel; and wherein the first connecting panel and the second connecting panel comprise an open-ended zipper assembly that zips together to connect the first connecting panel together with the second connecting panel.

According to a second broad aspect, the present disclosure provides a bed sheet system comprising: a fitted sheet configured to fit over a mattress, wherein the fitted sheet comprises a first connecting panel; a top sheet configured to fit over the fitted sheet, wherein the top sheet comprises a second connecting panel; and wherein the first connecting panel and the second connecting panel comprise an open-ended zipper assembly that zips together to connect the first connecting panel together with the second connecting panel. The top sheet includes an open-ended separating zipper along a top surface of the top sheet. The open-ended separating zipper is configured to traverse sides and a bottom of the top surface of the top sheet generally along a perimeter thereof. A duvet cover may be included, wherein the duvet cover includes an open-ended separating zipper along a bottom surface configured to traverse sides and a bottom of the bottom surface of the duvet cover generally along a perimeter thereof. The top sheet is configured to connect to the duvet cover via the open-ended separating zipper in an assembly. A duvet insert may be disposed between the top sheet and duvet cover in an assembly.

According to a third broad aspect, the present disclosure provides a method of assembling a bed sheet system comprising: fitting a fitted sheet over a mattress, wherein the fitted sheet comprises a first connecting panel having a first navigation patch; orienting a top sheet over the fitted sheet, wherein the top sheet comprises a second connecting panel having a second navigation patch; aligning the first navigation patch with the second navigation patch to orient the fitted sheet with respect to the top sheet; and connecting the first connecting panel to the second connecting panel. Embodiments may further include orienting a duvet cover over the top sheet, wherein the duvet cover comprises a navigation patch; aligning the third navigation patch with the first navigation patch and the second navigation patch to orient the duvet cover with respect to the fitted sheet and the top sheet; connecting a bottom side of the duvet cover to a top side of the top sheet to form a receiving area; inserting a duvet insert within the receiving area.

BRIEF DESCRIPTION OF THE DRAWINGS

The accompanying drawings, which are incorporated herein and constitute part of this specification, illustrate exemplary embodiments of the invention, and, together with the general description given above and the detailed description given below, serve to explain the features of the invention.

DETAILED DESCRIPTION OF THE INVENTION

Definitions

Figure 1A:
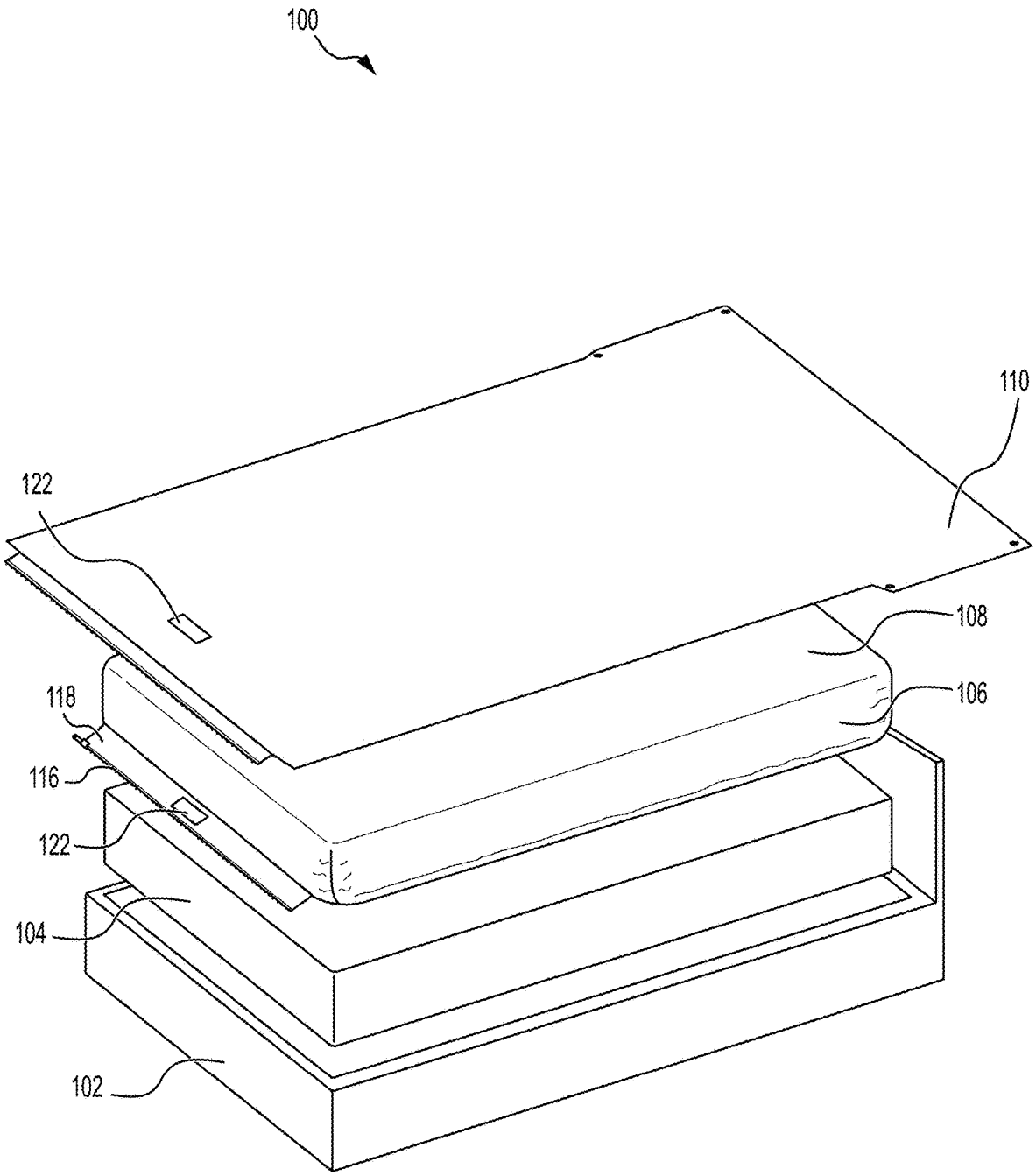
FIG. 1A is an illustration showing a bed sheet system in a bed assembly according to one embodiment of the present disclosure.

Where the definition of terms departs from the commonly used meaning of the term, applicant intends to utilize the definitions provided below, unless specifically indicated.

It is to be understood that the foregoing general description and the following detailed description are exemplary and explanatory only and are not restrictive of any subject matter claimed. In this application, the use of the singular includes the plural unless specifically stated otherwise. It must be noted that, as used in the specification and the appended claims, the singular forms "a," "an" and "the" include plural referents unless the context clearly dictates otherwise. In this application, the use of "or" means "and/or" unless stated otherwise. Furthermore, use of the term "including" as well as other forms, such as "include", "includes," and "included," is not limiting.

For purposes of the present disclosure, the term "comprising", the term "having", the term "including," and variations of these words are intended to be open-ended and mean that there may be additional elements other than the listed elements.

For purposes of the present disclosure, directional terms such as "top," "bottom," "upper," "lower," "above," "below," "left," "right," "horizontal," "vertical," "up," "down," etc., are used merely for convenience in describing the various embodiments of the present disclosure. The embodiments of the present disclosure may be oriented in various ways. For example, the diagrams, apparatuses, etc., shown in the drawing figures may be flipped over, rotated by 90° in any direction, reversed, etc.

For purposes of the present disclosure, it should be noted that to provide a more concise description, some of the quantitative expressions given herein are not qualified with the term "about." It is understood that whether the term "about" is used explicitly or not, every quantity given herein is meant to refer to the actual given value, and it is also meant to refer to the approximation to such given value that would reasonably be inferred based on the ordinary skill in the art, including approximations due to the experimental and/or measurement conditions for such given value.

For purposes of the present disclosure, the term "duvet insert" refers to an insert placed inside a separate cover. In some disclosed embodiments, the duvet insert may comprise a soft quilt filled with down, feathers, or a synthetic fiber.

For purposes of the present disclosure, the term "fitted sheet" refers to a sheet that fits snugly over a mattress. Fitted sheets may also known as bottom sheets and may typically include elastic bands in each corner to keep it from moving. They are designed to protect the mattress from dirt, dust, and other debris, and to provide a soft, comfortable surface to sleep on. Fitted sheets may be less likely to wrinkle than other types of bedding because they stretch over the mattress.

For purposes of the present disclosure, the term "top sheet" refers to a sheet that does not have elastic corners, but instead lies flat and may serve as a hygienic barrier between a body and any other bedding in use. Top sheets may also be known as flat sheets.

For purposes of the present disclosure, the term "zipper" refers to a device consisting of two flexible strips of metal or plastic with interlocking projections closed or opened by pulling a slide along them in a first direction and a second opposite direction, respectively. In some embodiments, the zipper may comprise a fastener consisting of two rows of metal or plastic teeth on strips of tape or fabric and a sliding piece that closes an opening by drawing the teeth together to mate them in a secure fitted connection. The sliding piece may also be drawn in a opposite direction along the rows of teeth to release the teeth from one another to create an opening and disassembly.

For purposes of the present disclosure, the term "open-ended zipper" refers to zippers that open fully so that the two sides of the zipper separate from each other. Some embodiments may include two-way, separating zippers that are those used in applications where one can open the zipper from the top or bottom and the application comes completely apart.

Description

While the invention is susceptible to various modifications and alternative forms, specific embodiment thereof has been shown by way of example in the drawings and will be described in detail below. It should be understood, however that it is not intended to limit the invention to the particular forms disclosed, but on the contrary, the invention is to cover all modifications, equivalents, and alternatives falling within the spirit and the scope of the invention.

Disclosed embodiments may include a combination of embodiments that are outlined in this document that may be categorized into newly designed bedding systems that have been engineered and designed with associated newly formed methods of placing on and the removing of the system from the mattress depending on the top coverings that are to be used on top of the bedding system. Traditionally, coverage used on top of sheet sets, which are often used but not necessary, are either blankets, comforters, quilts, coverlets, bedspreads, throws, and others, which will collectively be referred to as coverings. Alternatively, the traditional duvet insert, and duvet cover can be used, often collectively known as a duvet.

A first disclosed bedding relates to a sheet system that has any coverings that are anything other than a duvet on top of the sheet system. This will be referred to as Bedding System 1. A second invented bedding system relates to those bed coverings that have a duvet on top of the sheet system. This bedding system will be referred to as Bedding System 2. Bedding System 1 is the base for Bedding System 2. In other words, Bedding System 2 will build off of Bedding System 1 and will also have added integration and functionality with a newly designed duvet top, or cover as it is commonly known as, and duvet insert.

Finally, disclosed embodiments may introduce an option of a sheet folding board to alleviate the issues of folding and storing disclosed and/or or other bedding systems. Thus, the described sheet folding board may also be used with traditional sheet sets.

Figure 1B:
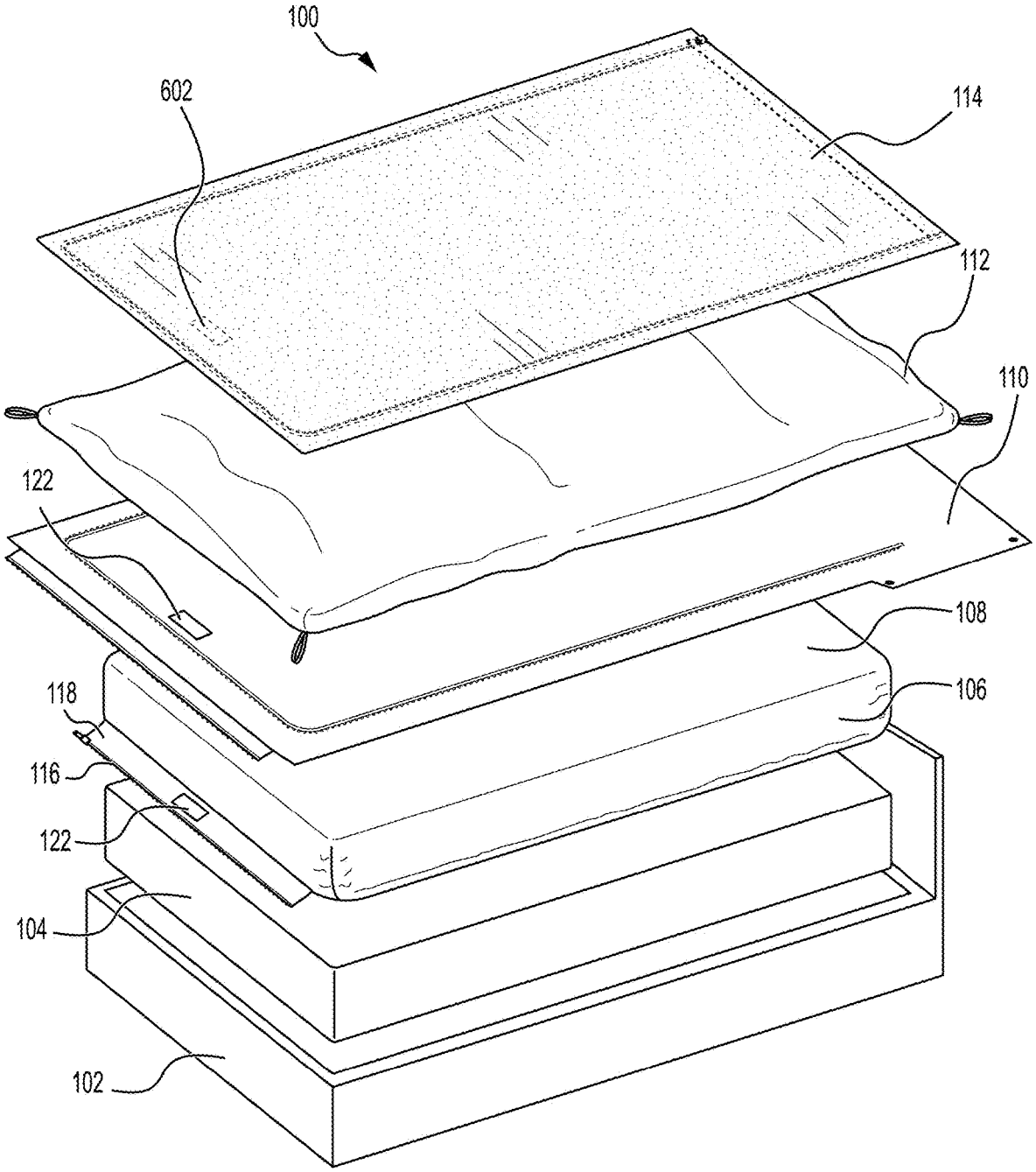
FIG. 1B is an illustration showing another bed sheet system in a bed assembly according to one embodiment of the present disclosure.

FIGS. 1A and 1B illustrate an exemplary bed sheet system in a bed assembly 100 including elements of Bedding System 1 (FIG. 1A) and Bedding System 2 (FIG. 1B) of the disclosed invention as described herein. Accordingly, a bed frame 102 may receive a mattress support such as a box spring 104 for supporting a mattress 106. Mattress 106 is covered by a fitted sheet 108. A top sheet 110 may be removably attached to fitted sheet 108. A duvet insert 112 may be fitted between a duvet cover 114 that may be removably attached to top sheet 110. Thus duvet insert 112 may be received between and/or within an assembly of duvet cover 114 with top sheet 110. The combination of duvet insert 112, duvet cover 114 and/or top sheet 110 may be used as a top layer of bedding to keep the sleeper warm as they rest.

Bedding System 1

The first bedding sheet system, also known as Bedding System 1, that will be described is for beds where traditional bed coverings, while often used but not necessary, are placed on top of a sheet set.

As illustrated in FIGS. 1A, and 2-4C, the structure of the first bedding sheet system is of two components that can be attached into one complete unit. It is comprised of one fitted sheet 108 and one top sheet 110 that are removably attached together. In one embodiment fitted sheet 108 and top sheet 110 may be zipped or attached together by an open-ended zipper 116 sewn onto a connecting panel 118. Open-ended zipper 116 is necessary so the two components can fully come apart. It is readily apparent that while a zipper apparatus has been described to removably attach fitted sheet 108 together with top sheet 110, any attachment means may be utilized to sufficient removably attach fitted sheet 108 with top sheet 110 including, but not limited to, for examples, buttons, clasps, loop and hook arrangements, tapes, adhesives, etc.

The first component of this bedding system illustrated in FIGS. 1A, and 2-4C is the top sheeting portion, otherwise known as the top sheet 110 in a traditional sheet set. In prior art, traditional top sheets are flat rectangular pieces of fabric, having folded hems to finish the sides of the fabric and are separate from the fitted sheet. The top sheet 110 in this bedding system varies from traditional top sheets in that it can attached to the bottom fitted sheet 108, such as via open-ended zipper 116. Furthermore, top sheet 110 may have different dimensions than traditional top sheets. While an open-ended zipper 116 is used to attach the top sheet 110 together with fitted sheet 108, it is readily appreciated that other devices or methods of attachment can be used. One half of the open-ended zipper 116 is sewn to the top sheet 110, such as along an extending fabric 404 extending from a foot end 402 of top sheet 110 (e.g., see FIG. 4A). Extending fabric 404 may serve as a connecting panel of top sheet 110. The other half of the open-ended zipper 116 is sewn onto a connecting panel 118 which extends from the fitted sheet 108. Thus, when the two halves are assembled and mated together by a sliding motion of open-ended zipper 116 to cause interlocking of the mated teeth of the zipper assembly, a secure connection is created between top sheet 110 and fitted sheet 108. Removal of top sheet 110 from fitted sheet 108 occurs simply by unzipping open-ended zipper 116. Closing open-ended zipper 116 may effectively join top sheet 110 to fitted sheet 108 via the extending fabric 404 and connecting patent 118, respectively.

In some disclosed embodiments, the corners 120 of the top sheet 110 may be eliminated to allow top sheet 110 to hang over the bed at a 90-degree angle on the side and back corners 120 of the mattress 106. This embodiment will eliminate the need to gather extra sheeting in the corners 120 for a square tuck, sometimes referred to as a military corner fold. A straight and clean tuck of extra sheeting fabric hanging over the side of the bed is much simpler and will help the top sheet 110 to stay tucked in, because there is no excess fabric in the corners which slips out easily and is hard to tuck in.

In some embodiments, it is preferred to have the width of the sheeting fabric on the foot end 402 in the back side corners 120 reduced by approximately 5" to 10" from the edge of the mattress in each corner to achieve a square corner, slightly narrower than the width of the corresponding mattress. While this embodiment is ideal, it is readily appreciated that more or less can be reduced as needed. Should the top sheet 110 be shortened in from the corner less than approximately 4", the top sheet 110 could extend beyond the bed if the fitted sheet 108 is not centered on the mattress or is pulled to one side or the other. If the top sheet 110 is shortened more than 10" on each side, it will be too short in the corners and the user will not have enough sheeting material to cover their feet adequately.

In some disclosed embodiments, the corner junction of the top sheet 110 should sit slightly above the corner of the mattress for maximum coverage so it lays smoothly on the mattress. In one embodiment, the 90-degree side corner 120 has reinforcing tape, twill tape, interfacing, or other reinforcing material sewn in or attached to the fabric at corner 120 to reinforce the fabric at this point. Will this is one disclosed embodiment, other embodiments may be used, because if the sheets are pulled from side to side, there will be stress on this fabric corner 120, and having the corner reinforced will prevent it from tearing.

The second component in Bedding System 1 is like that of a traditional fitted bed sheet but it has been re-engineered for better use and function. Traditional fitted or bottom sheets are comprised of one solid fabric piece, usually made of cotton, microfiber, linen, or other sheeting material, sewn together at the corners, and trimmed by an elastic band so it can be placed in a relatively fit manner over a 3-dimensional cuboid shape, often known as a mattress. The elastic provides some tension to help the sheet pull around and under the mattress and to assist it from not slipping off. Because these bottom sheets are typically made from all one type of fabric which has little to no stretch properties other than the elastic itself, and if the sheet is not deep enough or is unable to endure strain or stretch, the bottom fitted sheet typically comes off the mattress during use. In the prior art, to compensate for the fitted sheet popping off and not adequately covering the bed, and because mattresses come in all different depths, and due to rise in the sale of mattress foam tops, some fitted sheets have been designed to lengthen the sheeting fabric on all sides of the fitted sheet to give it more depth, otherwise known as a 'deep pocket sheet.' This is not ideal for most mattresses, because while the sheet can mathematically cover the top and side surface areas of the mattress generously, and you can attempt to tuck under the bottom of the mattress the excess fabric that is not needed in the width and length, when sleepers move around on top of the bottom sheet, the fabric comes loose and does not remain taught over the mattress thus making it uncomfortable to lie on and unsightly as it hangs loose on the sides.

Figure 3:
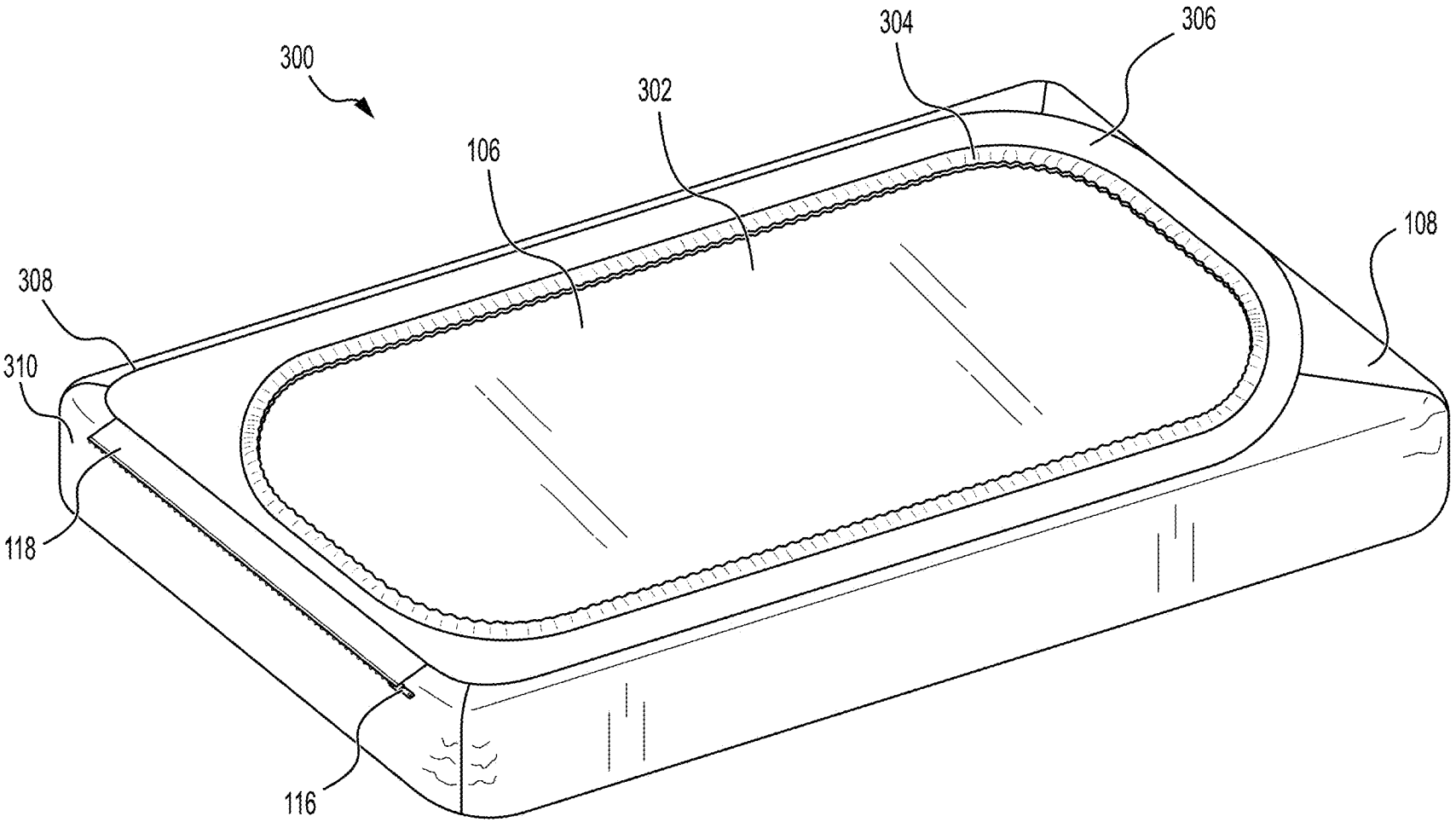
FIG. 3 is bottom perspective view of the mattress of FIG. 2 with a fitted sheet according to one embodiment of the present disclosure.

For this newly invented Bedding System 1, FIG. 3 illustrates a bottom view of fitted sheet 108 fitted to mattress 106. Along the bottom, fitted sheet 108 has an opening 302 having a banding of elastic 304 along a circumference of opening 302 in fitted sheet 108. Set back from banding of elastic 304 is a band of stretch fabric 306 along a perimeter thereof. The band of stretch fabric 306 is further connected to a perimeter of the fabric of fitted sheet 108. Thus, the fabric of fitted sheet 108 transitions to band of stretch fabric 306 to banding of elastic 304 along a perimeter of opening 302.

Band of stretch fabric 306, preferably but not restricted to a recycled stretch polyester or other material with strong elastane properties that recovers well, has been sewn in or attached all the way around the circumference of the fitted sheet 108 material. Instead of just lengthening the sheeting fabric which will not stay tight on the bed, this band of stretch fabric 306 added onto the fitted sheet 108 will pull taught any excess fitted sheet 108 fabric underneath the mattress 106 much better than just the traditional sewn in elastic band and will give the fitted sheet 108 the right amount of flexibility needs to cover different mattress depths.

In a preferred embodiment, the width of this band of stretch fabric 306 ideally would be approximately 3" to 7," however, it is readily appreciated more or less material can be used. In one preferred embodiment, if the band of stretch fabric 306 is too narrow, it will not have enough strength or length to add sufficient depth to cover the mattress 106 while pulling in the extra fitted sheet 108 fabric taught. If the band of stretch fabric 306 is too wide, it will make it hard to remove Bedding System 1 because the edge of the fitted sheet 108 will sit too far under the mattress 106 and a user won't be able to reach under the mattress 106 to remove Bedding System 1 off the mattress 106.

Banding of elastic 304 is disposed along the edge of band of stretch fabric 306. In one disclosed embodiment, banding of elastic 304 on fitted sheet 108 is approximately ½ inch to 1 inch rubber grip elastic 5 which is stronger than traditional elastic used on most conventional fitted sheets on the market. The rubber grips and elastic hold the fitted sheet 108 in place better vs. an encased or regular elastic usually found on regular fitted sheets. It is readily appreciated that other types of elastic can be used as needed.

Figure 4A:
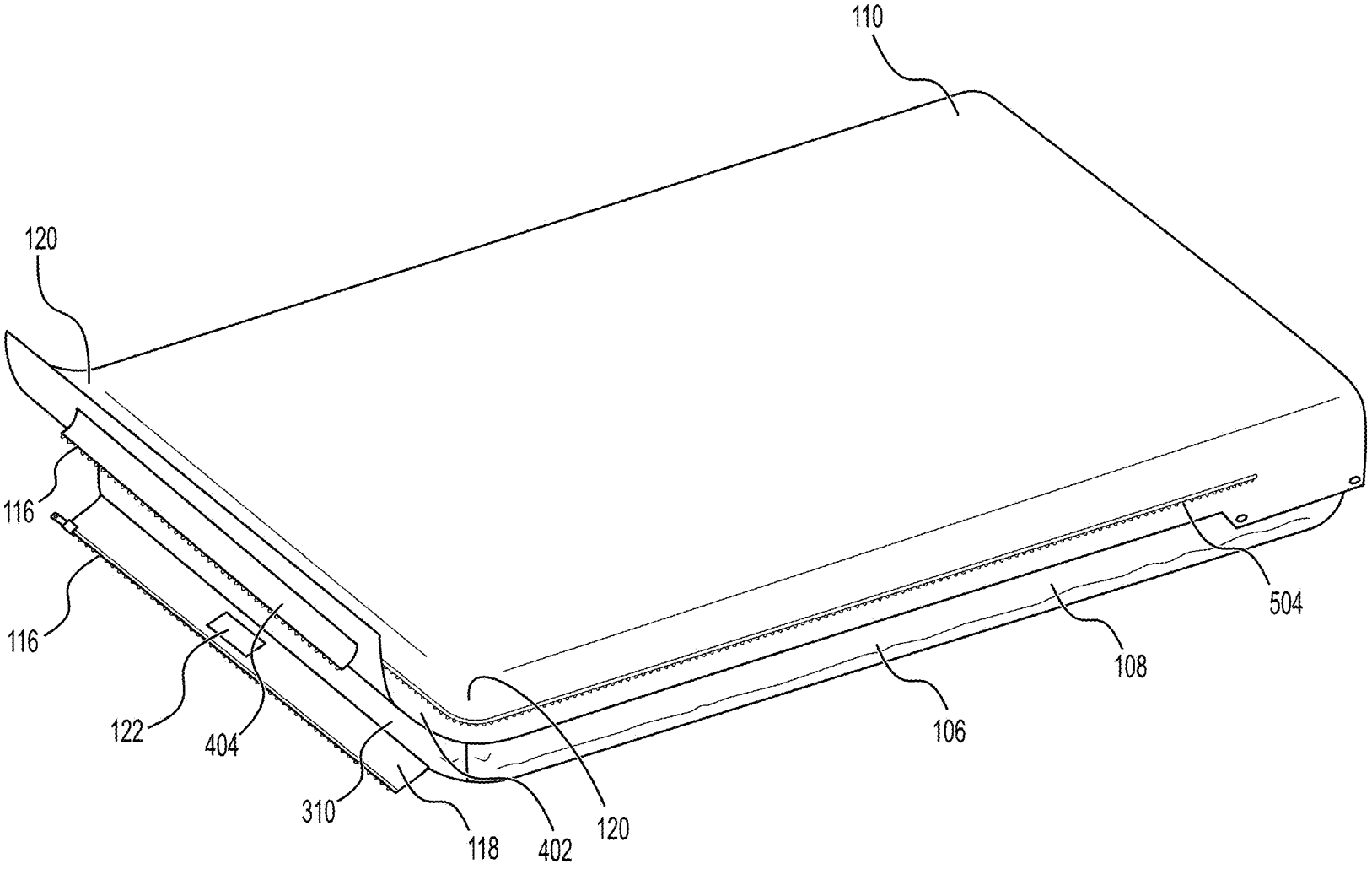
FIG. 4A is perspective view of a top sheet having an exposed connection panel oriented with respect to a mattress fitted with a fitted sheet according to one embodiment of the present disclosure.
Figure 4B:
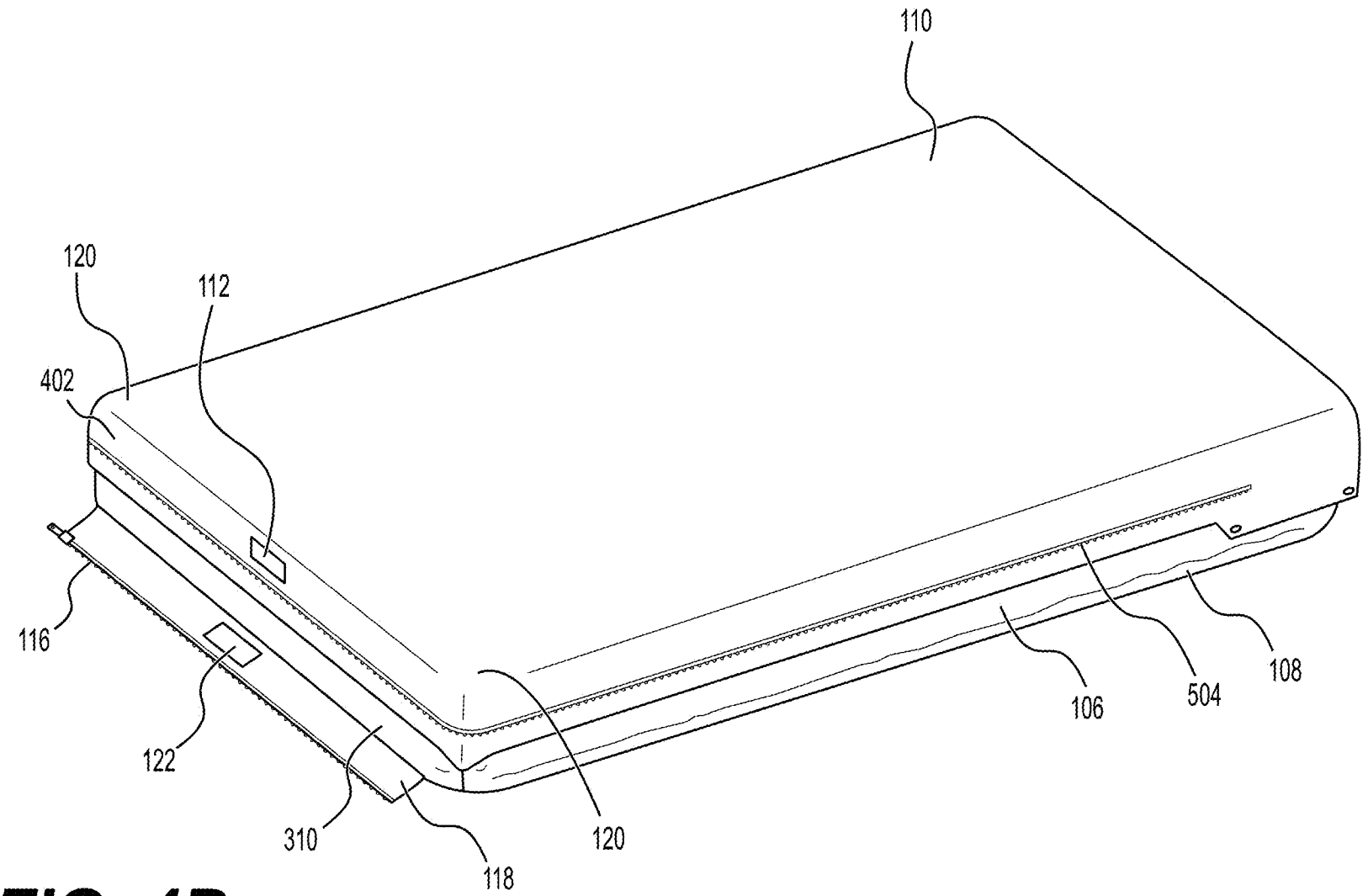
FIG. 4B is perspective view of a top sheet having a hidden connection panel oriented with respect to a mattress fitted with a fitted sheet according to one embodiment of the present disclosure.
Figure 4C:
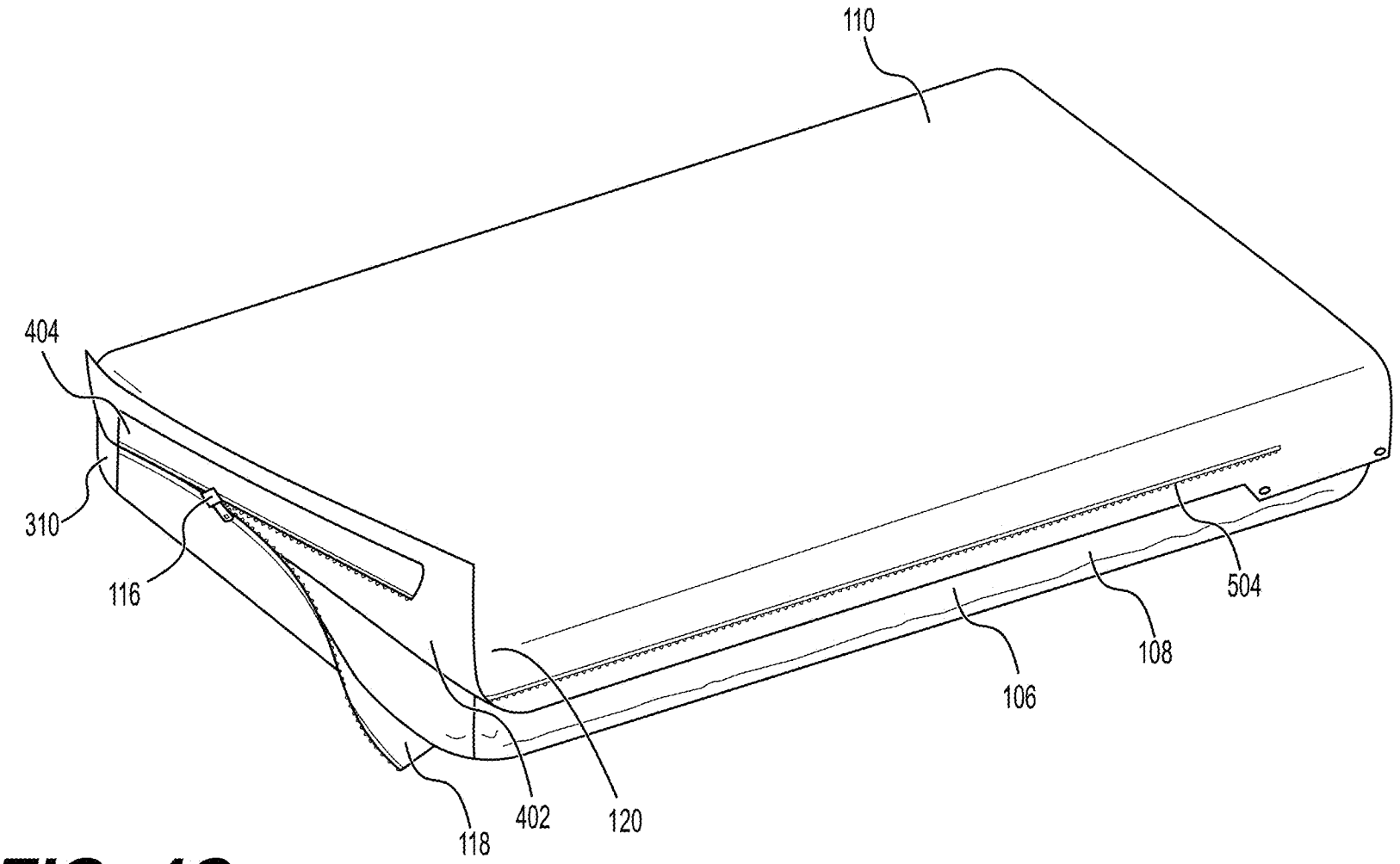
FIG. 4C illustrates attaching the connection panel of a top sheet to the connection panel of a fitted sheet according to one embodiment of the present disclosure.

Referencing FIGS. 4A-4C, the foot end 402 of the top sheet 110 is then zipped to the fitted sheet 108. The connecting panel 118 that has one half of the open-ended zipper 116 on one end is sewn into the fitted sheet 108 where the fitted sheet 108 and the band of stretch fabric 306 are joined at seam 308. This embodiment will attach the connecting panel 118 here, because this seam 308 will be able to be reinforced with multiple stitches and reinforcing material like the corners 120 of the top sheet 110, and will have enough strength that if tugged on, fitted sheet 108 and top sheet 110 will stay together resisting tearing. The top sheet 110 has the other half of open-ended zipper 116 on extending fabric 404 on its foot end 402. It is important that open-ended zipper 116 lays on the vertical side of the mattress 106 at the foot of the bed so that sleepers cannot feel the open-ended zipper 116 if hanging their feet over the foot of the bed 310. Thus, when assembled, open-ended zipper 116 of connecting panel 118 of fitted sheet 108 is zipped with open zipper 116 of extending fabric 404 from top sheet 110 to mate fitted sheet 108 within top sheet 110.

In some embodiments, top sheet 110 is illustrated having an open-ended separating zipper 504. This zipper 504 is an optional feature of top sheet 110 in Bedding System 1. The aforementioned configuration of top sheet 110 having open-ended separating zipper 504 may be more likely reserved as an added feature in another embodiment such as that described later in Bedding System 2 below.

Advantages of the disclosed embodiment will allow for the top sheet 110 to be unattached from the bottom fitted sheet 108 in all other places except across the foot of the bed 310 with open-ended zipper 116. Therefore, when the top sheet 110 is pulled up over the bed, one's feet or lower limb portions are not enclosed or trapped in Bedding System 1 and can still hang over the end of the bed, as is often the case for taller people. Also, many people stick their lower limbs out of the side of the sheets to cool off slightly. By having the fitted sheet 108 and the top sheet 110 attached at open-ended zipper 116, the sheet system will remain intact if the sheet system is pulled on in any manner. There will be no more need for restless sleepers to get up in the middle of the night to readjust or re-tuck their sheets in.

Finally, Bedding System 1 is a preferred embodiment for the elderly, young, or people that have trouble lifting the mattress. This sheet system will remain on the bed in place during the entire duration of use because the band of stretch fabric 306 and banding of elastic 304 will keep the fitted sheet 108 in place, and because the sheets are zipped together the top sheet 110 will remain "tucked in." Hence the mattress 106 will not need to be lifted until there is assistance to help change and launder the sheet set. While this is a preferred embodiment, it is readily appreciated that the fitted and top sheet can be connected in other manners as needed.

The installation of the disclosed bedding system on a mattress 106 is unique and differs from traditional bedding sets. Referencing FIGS. 1A, 2, 4A, 4B and 4C, on the interior of the fitted sheet connecting panel 118, and on the inside foot end 402 of the top sheet 110 a navigation patch 122, with a branded logo, or other type of marking or word to indicate the foot end of the sheet, otherwise known as a label, crest, or marking has been sewn on or attached visibly at the foot of the bed to clearly mark where the foot end of the bedding system is. Preferably, navigation patch 122 may be clearly visible when putting on fitted sheet 108 and top sheet 110 (note, in some disclosed embodiments, the navigation patch 122 will be hidden when fitted sheet 108 and top sheet 110 are attached except for the stitch lines (as shown in FIGS. 3 and 4C), because as seen in prior art, labels have been tucked into the inside seams of the sheets which enclose the standard elastic and sometimes can be hard to find and confusing with the volume of material there is in a fitted sheet.

Users who are making the bed or putting on Bedding System 1 will first locate this navigation patch 122 on the fitted sheet 108 on the inside of the connecting panel 118. This is the foot end 402 of the fitted sheet 108. Then, they will place the fitted sheet 108 onto the foot end 310 of the mattress 106 and around onto the head end of the mattress 106. Once complete, the user will find the navigation patch 122 on the top sheet 110 on the inside of the fitted sheet 108 at the foot end 402. The user will lay the top sheet 110 onto the fitted sheet 108 and zip the sheets together via open-ended zipper 116. The only step left is to pull up the top sheet 110 and Bedding System 1 is on the bed. The navigation patch 122 clearly guides one in the orientation of the bedding system so they will never put the fitted sheet 108 or the top sheet 110 on and subsequently find out they have it oriented incorrectly. Also, the fact that the top sheet 110 has been positioned centrally because the sheets can be zipped together, the need for going side to side of the mattress to pull on the top sheet 110 to make sure it is even on both sides is not necessary anymore.

The length of the top sheet 110 has been lengthened to generously cover any coverings that may be on top of the sheets. Referencing FIGS. 1A, 4A-4C, 9A, and 9B, top sheet 110 may be folded over the coverings and a retaining or closure device, such as a snap 902, is used to secure the fold over down to keep it folded during use. While this embodiment uses a snap 902 is preferred (because it will not hook onto any clothing of the user or scratch or harm the user), other embodiments may be used such as a button, hook, Velcro, or any kind of fastener sufficient to retain a fold of top sheet 110 over coverings.

Figure 12:
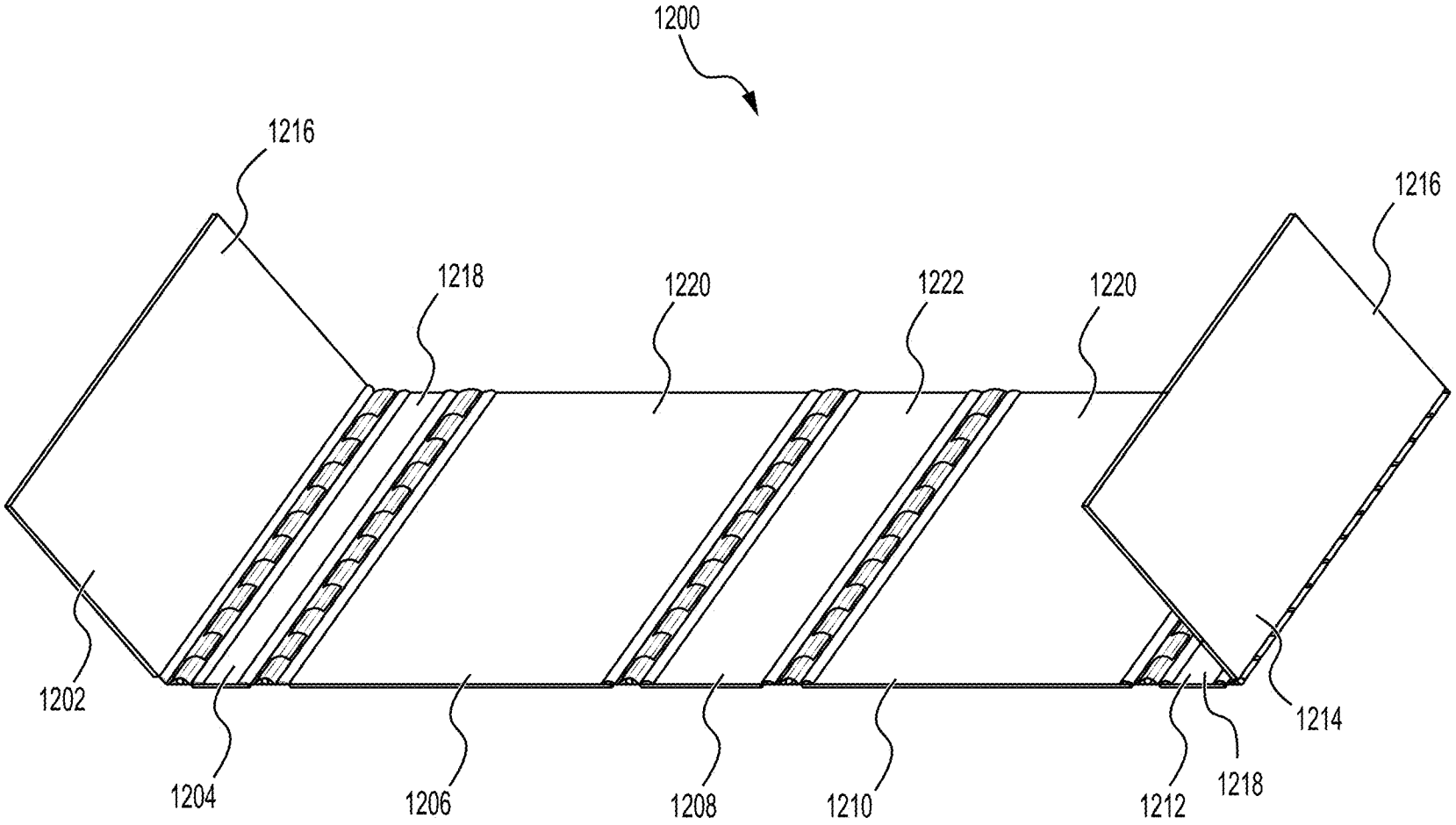
FIG. 12 illustrates a folding board according to one embodiment of the present disclosure.
Figure 13:
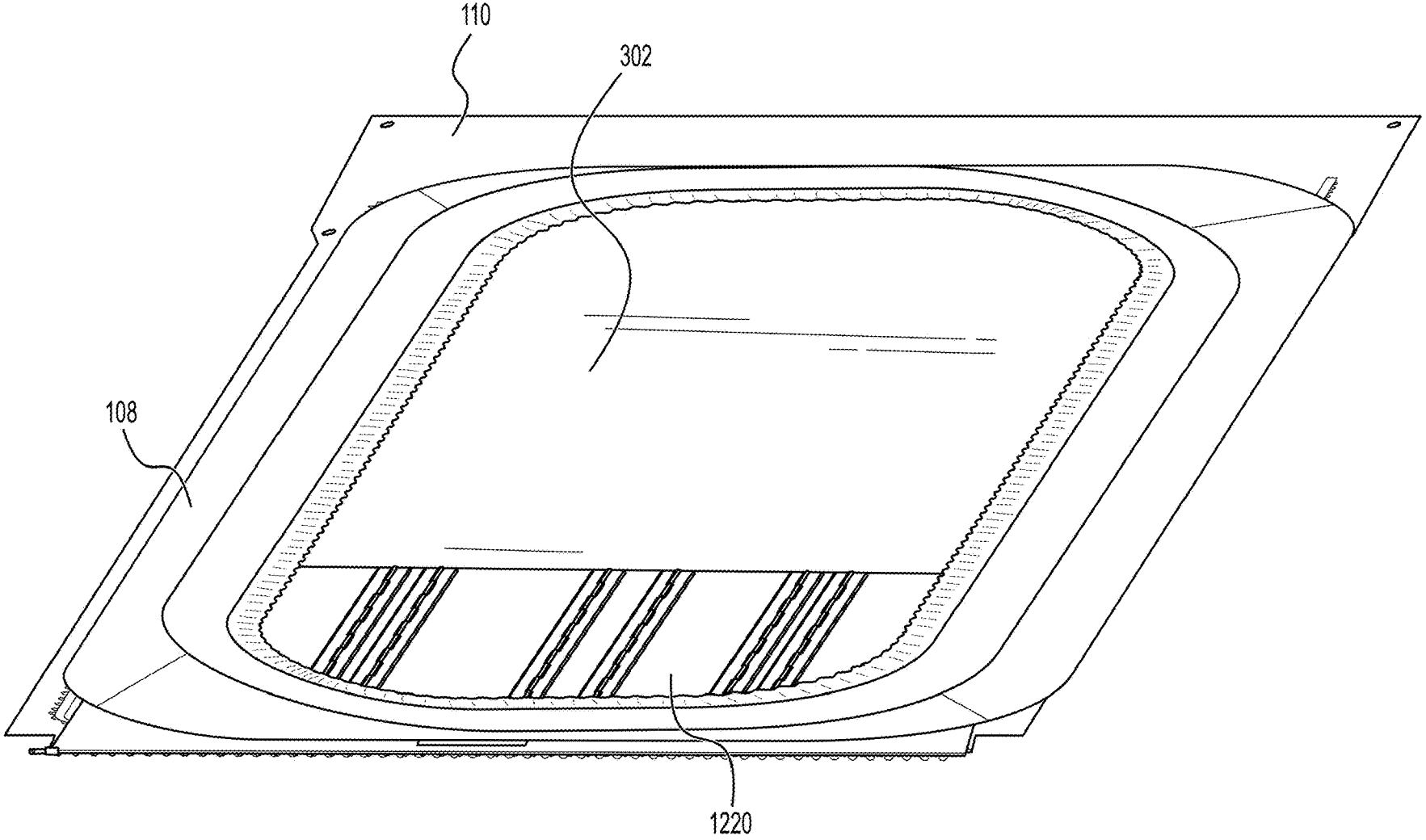
FIG. 13 illustrates a folding process of a bed sheet system using a folding board according to one embodiment of the present disclosure.
Figure 14:
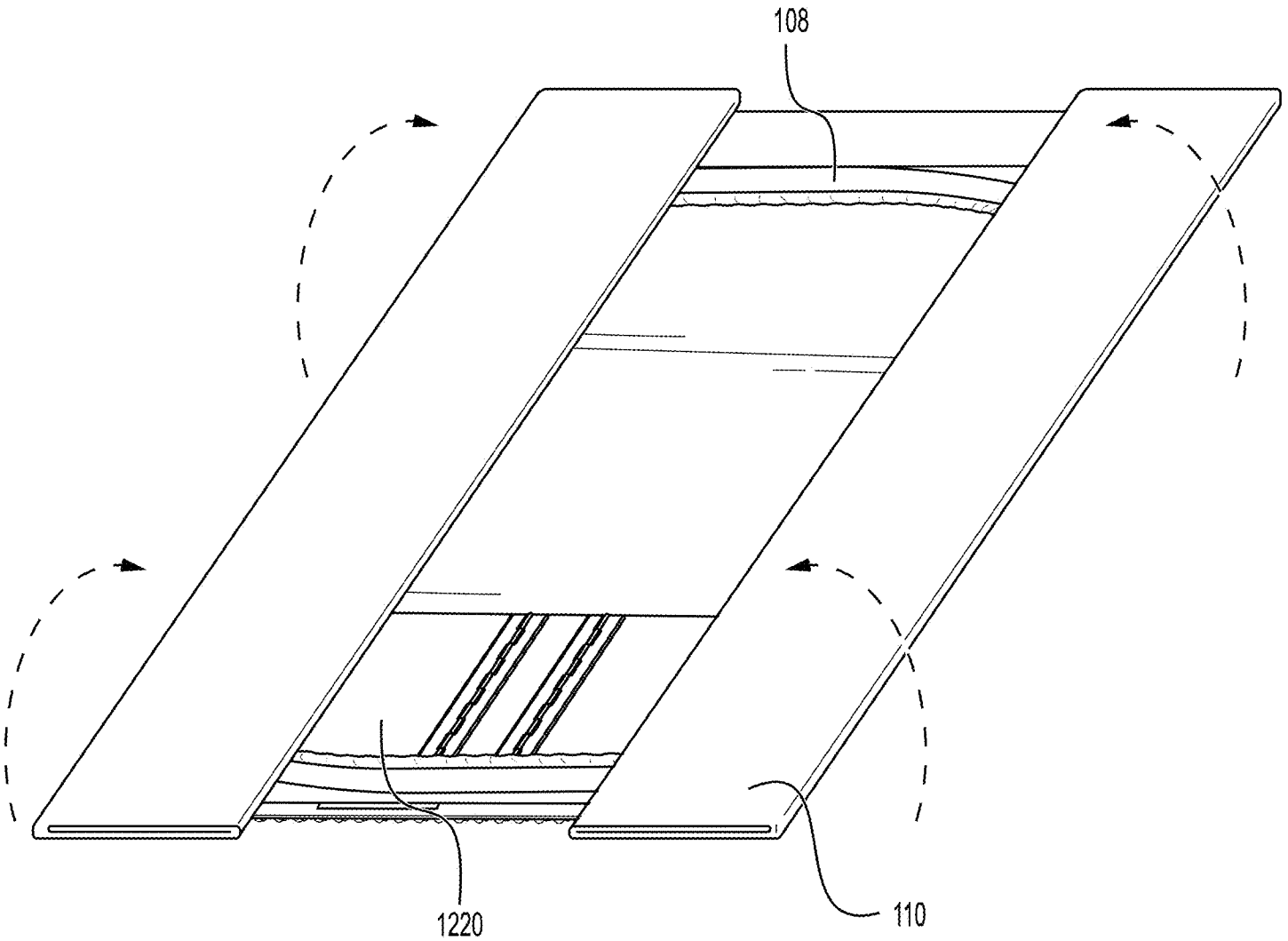
FIG. 14 illustrates a continued folding process of a bed sheet system using a folding board according to one embodiment of the present disclosure.

Many users of traditional bed sheets find the fitted sheet especially hard to fold because of the shape of the sheet and the elastic banding. Bedding System 1 also has a fitted sheet 108 component which users may find challenging to fold as well. Therefore, users will have the option of using the associated bed sheet folding board 1200 as shown in FIGS. 12-14 and described later within this document for easy folding and neat storage. Folding board 1200 has 7 sections (1202, 1204, 1206, 1208, 1210, 1212, 1214) made of 4 different sizes (1216,1218,1220,1222) as shown in FIG. 12 separated by hinges, attachments, routered edges, seams, or any other type of fastener or movable bend which connects the panels that can allow the panel pieces to swing 360 degrees.

The folding board 1200 may employ a line of stitches such as on the cork fabric to separate its sections. This embodiment uses fabric with sections sewn to separate the sections, because if one uses hinges made of metal or any sharp object, or any other type of material that may be sharp, it may rip the fitted sheet 108 or top sheet 110. Also, cork fabric may be used, because it is moisture resistant and is hypoallergenic, therefore safe to use while folding and storing sheets. Another alternate way to make folding board 1200 is to create it out of plastic or some other formable material which would be lightweight, and the sections could move 360 degrees. While this may be a preferred embodiment, it is readily appreciated that other embodiments can be used as needed.

Referring to FIGS. 12-18, a first step to fold Bedding System 1 is to place the top sheet 110 on top of a flat surface, for example your bed. Next, place the fitted sheet 108 upside down so the band of elastic 304 and band of stretch fabric 306 are facing up. Ensure the top sheet 110 is pulled completely out and flat on the surface, and the fitted sheet 108 likewise. Place the folding board 1200 inside the end of the fitted sheet 108 and fold into the board the end of the top sheet 110 that is hanging closest to you. Once complete, fold in the long sides of the top sheet 110 towards the center so the sheet set is as wide as the board 1200 as FIG. 14 illustrates.

Figure 15:
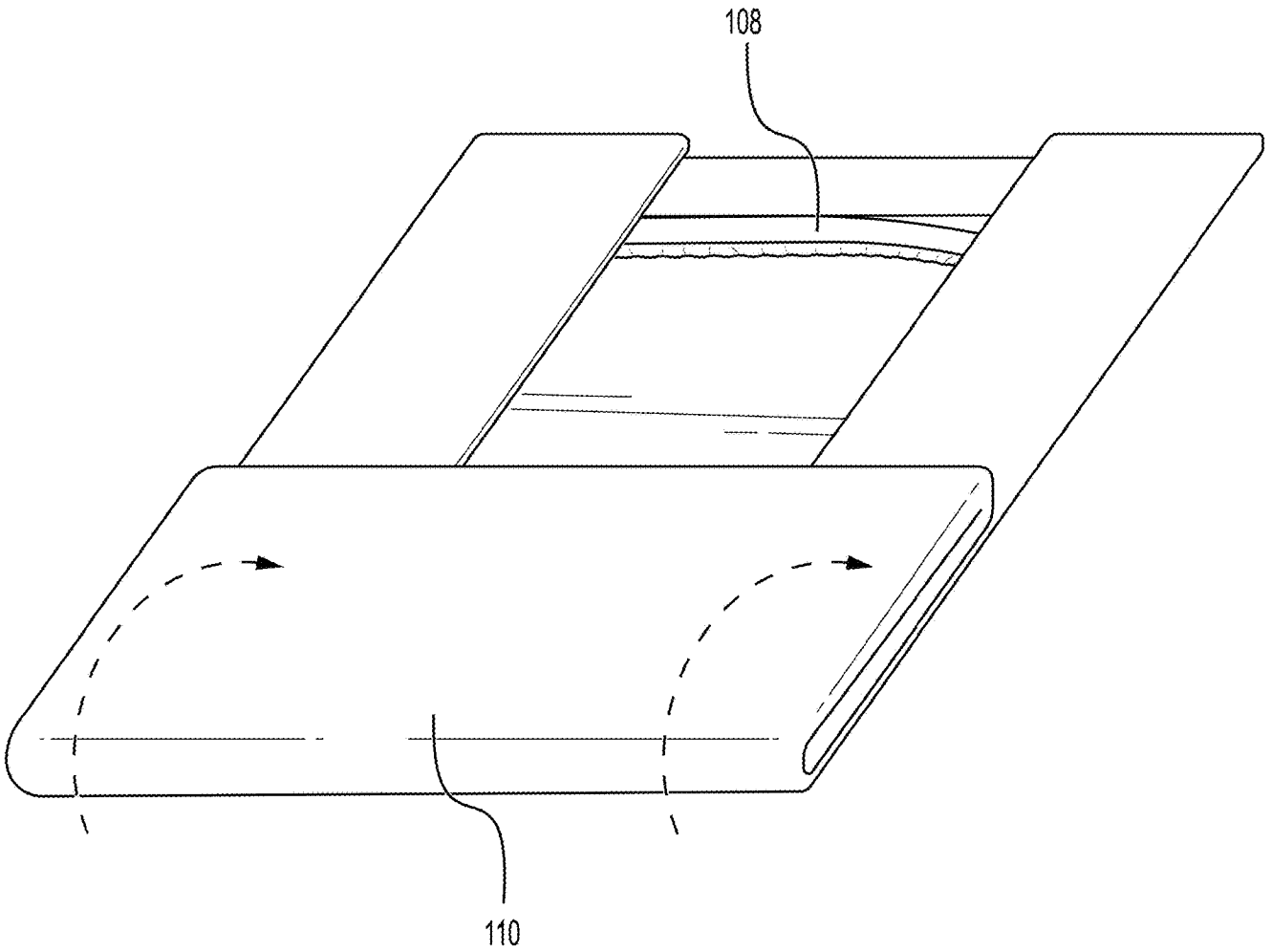
FIG. 15 illustrates a further continued folding process of a bed sheet system using a folding board according to one embodiment of the present disclosure.
Figure 16:
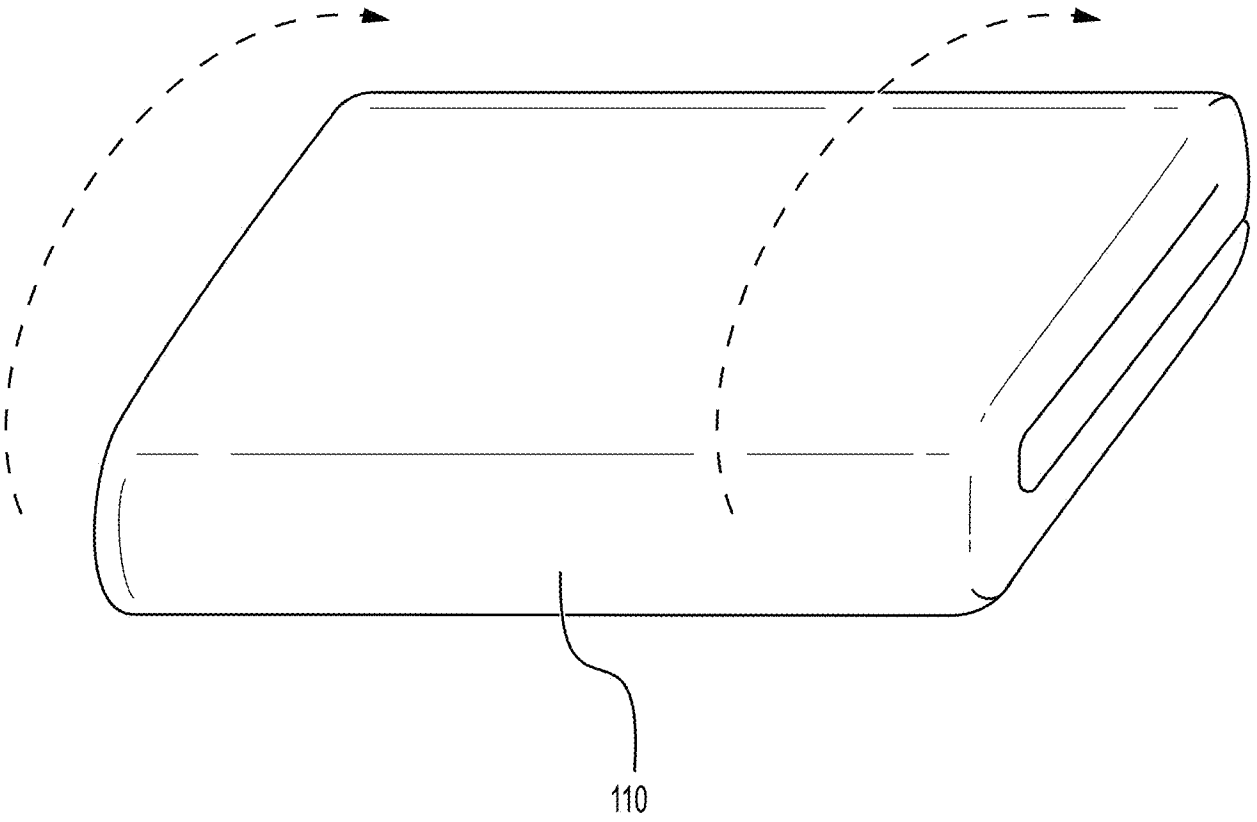
FIG. 16 illustrates a finishing continued folding process of a bed sheet system using a folding board according to one embodiment of the present disclosure.
Figure 17:
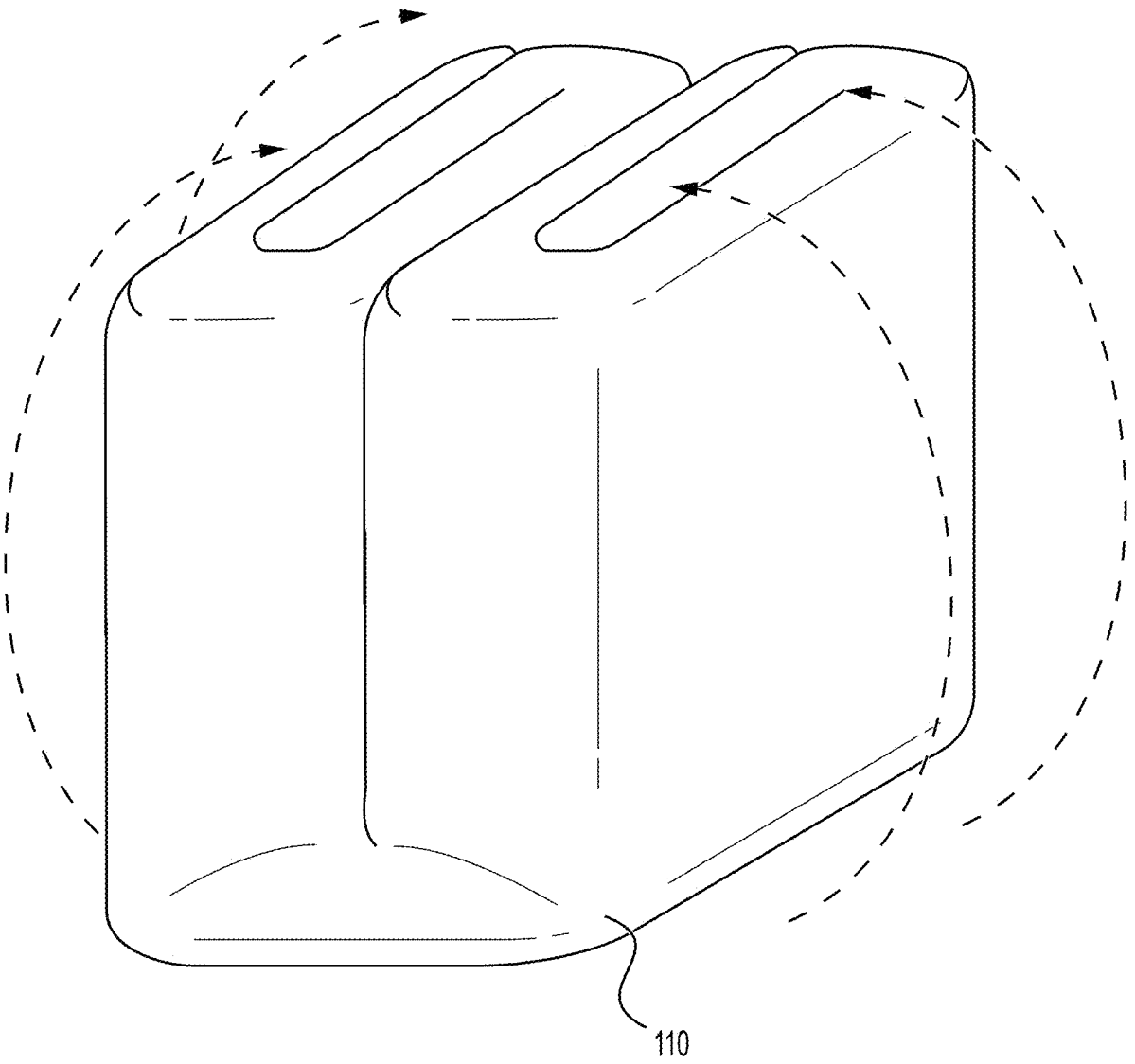
FIG. 17 illustrates an orienting and finishing continued folding process of a bed sheet system using a folding board according to one embodiment of the present disclosure.
Figure 18:
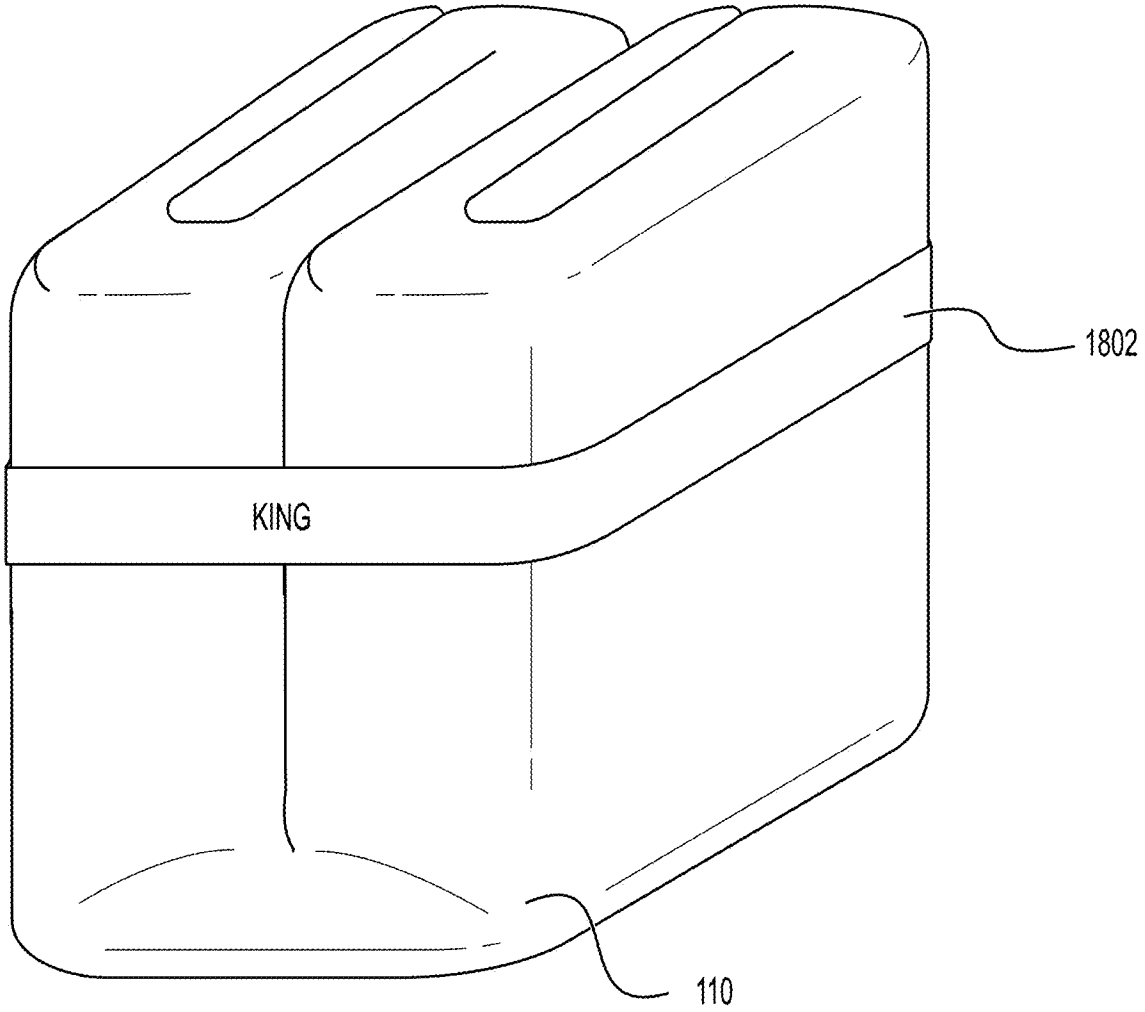
FIG. 18 illustrates a retainer for a finished folding of a bed sheet system using a folding board according to one embodiment of the present disclosure.

As shown in FIG. 15, flip over the folding board 1200, rotating the long end of the board that is closest to you over, working your way to the end of the top sheet 110 and fitted sheet 108 until a full turn is not possible. Fold in the short remaining portion of the top sheet 110 once there is not a full turn of sheeting to be made. Finally, fold in the outside panels of the board 1200 into the middle and once again so it makes a compact cuboid shape (e.g., see FIGS. 15-17). One can place the optional Sheet Band 1802 around the sheet set to store as illustrated in FIG. 18. The sheet band 1802 will keep the folded sheets and board 1200, which is folded into the sheet set, together while indicating the size of sheet (Twin, Queen, King) that has been folded for future use. While the folding board 1200 is a preferred embodiment and process of folding Bedding System 1, it is readily appreciated that other methods of folding sheets can also be used.

Bedding System 2

The second bedding system, otherwise known as Bedding System 2, that will be described is for use with a duvet insert. Using this system will eliminate the use of a traditional duvet cover and the traditional sheet set.

A traditional duvet cover consists of a two-sided cover made of fabric usually sewn on three sides with an opening on the fourth side to insert the duvet blanket. The purpose of the duvet cover is to keep the duvet insert clean while also providing esthetic properties to your bedding. A duvet insert inside a duvet cover will collectively be known as a duvet.

The traditional duvet cover along with other designs of duvet covers that exist today are often exceedingly difficult to put on. Users are often stuffing, tugging, rolling, shaking, and climbing into the covers to get the duvet inserts in place inside the cover. Often the duvet insert is not placed centrally in the duvet cover and the duvet insert will slip to one side or the other during use or will be out of place for the entirety of use if not put on properly. This will often cause much frustration for users and will in some cases make users switch back to traditional coverings because of the difficulty of putting on the duvet cover on the duvet insert.

Another problem with using traditional duvet covers is when duvet users put traditional sheets on their bed and cover it with a duvet, during use the sheets slip, pull out or untuck causing direct exposure to the duvet cover. This is very frustrating for those that launder or make the beds because now they are forced to pull the duvet off to replace the top sheet on the bed properly, and or, when it comes to laundering, they feel the need to wash both the duvet cover and the sheet set vs. just washing the sheet set. Some have alleviated this problem by eliminating the top sheet altogether which solves the displacement of the top sheet, but then users will be exposed directly to the duvet cover and will have to launder it more often. Then comes the challenging task of getting your duvet cover off and back on the duvet insert.

According to some experts, not laundering your sheets for over two weeks can cause bacteria, dust mites, fungi, mold, or bed bugs to exist and grow on your sheets and duvet cover which can potentially cause breakouts, whiteheads, skin inflammation, and intense itching. It can also cause skin problems like acne, eczema or worsen existing skin conditions.

There have been several attempts to solve one or more of these issues regarding sheets and duvets, but none of them have solved the problem in its entirety. There are a few designs on the market today of duvet covers that make them somewhat easier to put on. For example, a 3-sided zipped duvet cover makes it easier to put on the duvet cover but does not resolve the issue of keeping the top sheet tucked and on the bed. Or, if the sheets are misplaced, one then must wash the whole duvet cover each time you want to launder your bedding.

Another alternative solution that is on the market is a bedding product that zips the quilted top cover to the base of the system (in essence, it is quilted fitted sheet) which will keep the bedding on the bed. The problem with this system is that while it works, due to the quilting, it is extremely hot for sleepers and does not allow you to lie on simple cotton sheets directly. Also, it is difficult to launder, and it is only recommended to wash it once a week because of the layered or quilted material. Also, the zippers are at the 3 top edges of the bed and sleepers may rub against them while sleeping or getting out of bed which would be uncomfortable. Finally, the top cover is as wide as the top of the bed, and while it does have short pieces of fabric on the sides to extend coverage for sleepers, this would not sufficiently cover large adult sleepers effectively, leaving you uncovered while sleeping.

Bedding System 2 that has been invented and will be described hereafter will alleviate the problems of the sheets being displaced and the problem of placing the duvet insert in the duvet cover. This new bedding system combines the sheet set that was outlined in Bedding System 1 with a few modifications, and a traditional duvet cover for one complete integrated system. Simply outlined, the top sheet of the integrated sheet set with a few modifications described in Bedding System 1 will become the bottom of the duvet cover, eliminating a separate duvet cover, and making the top sheet perform dual purpose of a top sheet and the bottom side of the duvet cover.

FIG. 1B is a complete overview of the layers of Bedding System 2. The base layer upon which this system lays is the mattress 106. The fitted sheet 108 is placed on the mattress 106 and is attached to the top sheet 110 via a connecting panel 118 of fitted sheet 108 mated to extending fabric 404 of top sheet 110 via open-ended zipper 116. There is a navigation patch 122 on the top sheet 110 and the fitted sheet 108, to help users orient and find the foot end of top sheet 110 and the fitted sheet 108 so one can put top sheet 110 and the fitted sheet 108 on the right way the first time. Referencing FIGS. 5, 6, 9A, 9B, and 10, the top sheet 110 has been made extra-long and has a generous fold-over 502 at the head of the top sheet 110. The fold-over 502 will stay in place by a retaining device, such as snap 902, on each side of the top sheet 110.

Referencing FIGS. 1B, 4A-4C, 5, 6, 7A, 8A, 9A, 10 and 11, top sheet 110 may include an open-ended separating zipper 504 disposed on a top surface of top sheet 110. In some disclosed embodiments, open ended separating zipper is attached to the top surface and generally traverses the outer perimeter along the sides and bottom of the top sheet 110. A duvet cover 114 is provided having a top surface and a bottom surface. An open ended-separating zipper 504 may be provided along the bottom surface of duvet cover 114. Thus, in some embodiments, open-ended separating zipper 504 is configured to generally traverse along the perimeter sides and bottom of the bottom surface of duvet cover 114.

Figure 5:
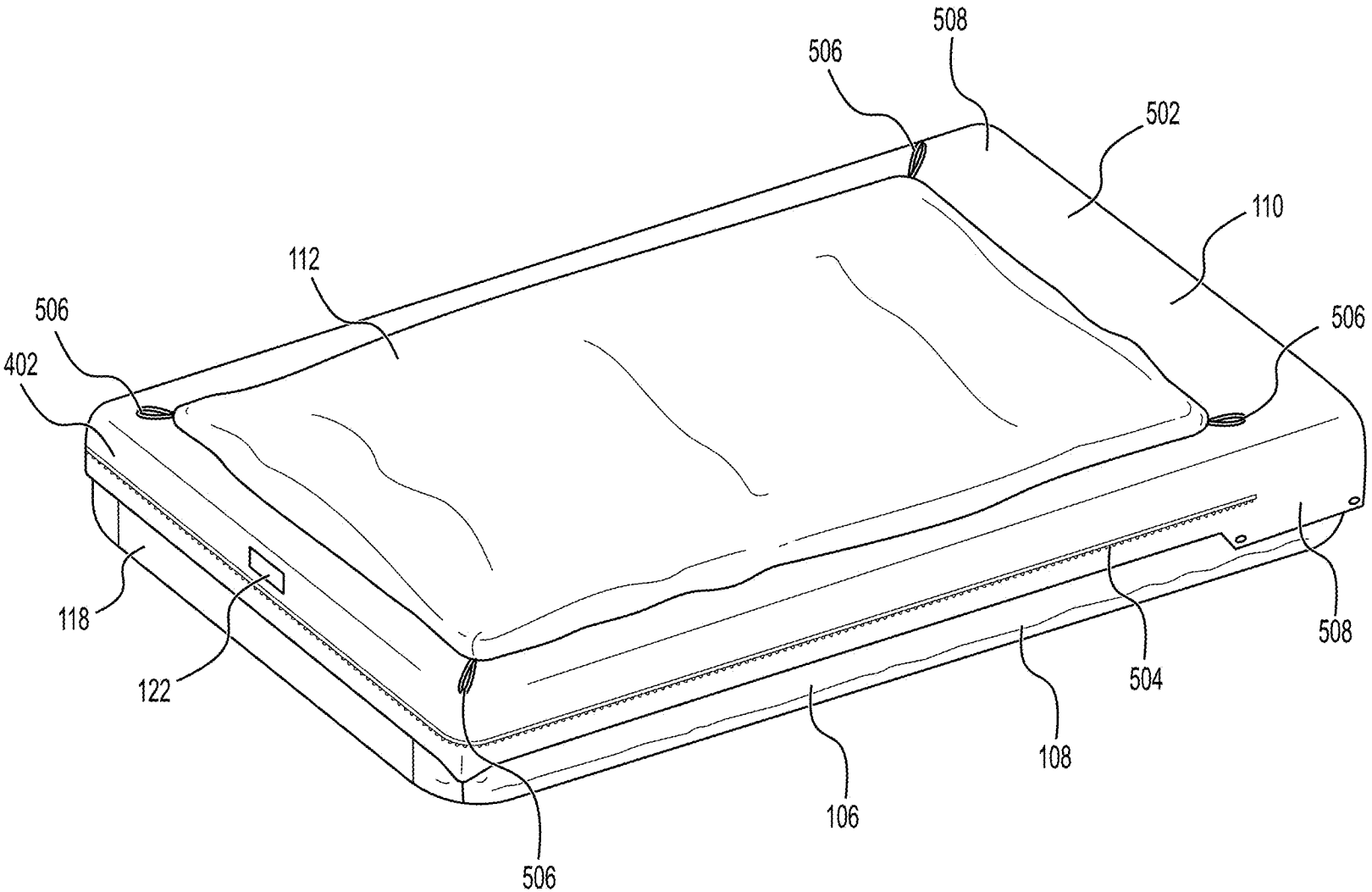
FIG. 5 is perspective view of a duvet insert disposed in an orientation with respect to a top sheet and a mattress fitted a fitted sheet according to one embodiment of the present disclosure.

The top sheet 110 will be attached to the duvet cover 114 by open-ended separating zipper 504 such that when the open-ended separating zipper 504 is zipped in a closed position, top sheet 110 and duvet cover 114 are connected in an assembly. FIG. 5 illustrates only one side of the open-ended separating zipper 504. Once the fitted sheet 108 and top sheet 110 are in place and the open-ended separating zipper 504 is closed, a duvet insert 112 is placed on the bed directly on the top sheet 110. Finally, the duvet cover 114 is placed on top of the duvet insert 112 and zipped together by zipping the two portions of the open-ended separating zipper 504 together. While this is a preferred embodiment to integrate a traditional duvet cover and traditional sheet set, it is readily appreciated that other methods and notions can be used as needed. Next the components of Bedding System 2 will be described in detail.

Traditional fitted or bottom sheets are comprised of one solid fabric piece, usually made of cotton, microfiber, linen, or other sheeting material, sewn together at the corners, and trimmed by an elastic band so it can be placed in a relatively fit manner over a 3-dimensional cuboid shape, often known as a mattress. The elastic provides some tension to help the sheet pull around and under the mattress and to assist it from not slipping off. Because bottom sheets are typically made from all one type of fabric which has little to no stretch properties other than the elastic itself, and if the sheet is not deep enough or is unable to endure strain or stretch, the bottom fitted sheet typically comes off the mattress during use. In the prior art, to compensate for the fitted sheet popping off and not adequately covering the bed, and because mattresses come in all different depths, and due to rise in the sale of mattress foam tops, some fitted sheets have been designed to lengthen the sheeting fabric on all sides of the fitted sheet to give it more depth, otherwise known as a 'deep pocket sheet'. This is not ideal for most mattresses because while the sheet can mathematically cover the top and side surface areas of the mattress generously, and you can attempt to tuck under the bottom of the mattress the excess fabric that is not needed in the width and length, when sleepers move around on top of the bottom sheet, the fabric comes loose and does not remain taught over the mattress thus making it uncomfortable to lie on and unsightly as it hangs loose on the sides of the mattress.

Figure 2:
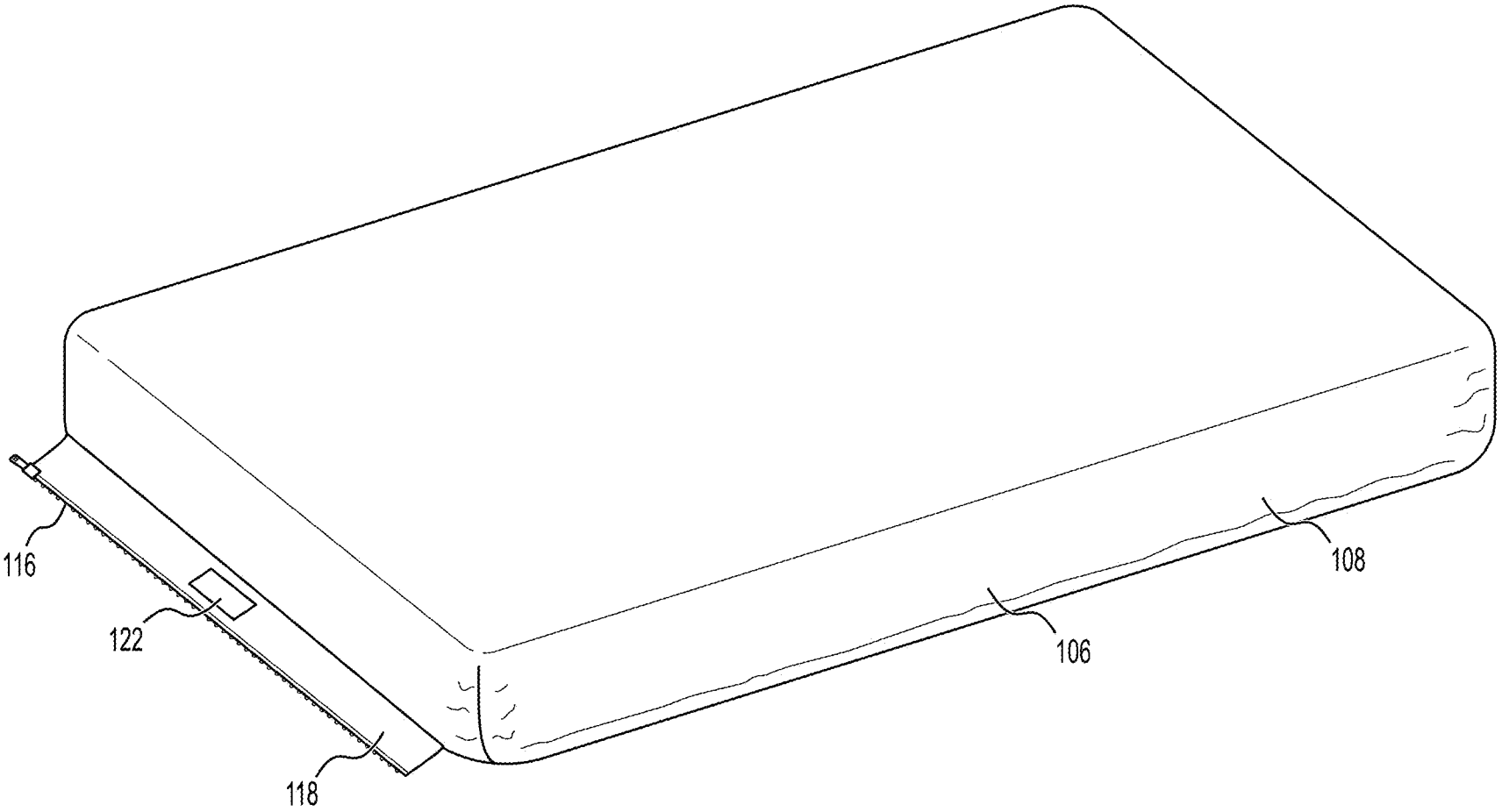
FIG. 2 is top perspective view of a mattress with a fitted sheet according to one embodiment of the present disclosure.

For this newly invented Bedding System 2 the fitted sheet 108 as depicted in FIGS. 1B, 2 and 3, for example, may be employed. Accordingly, as previously described, FIG. 3 illustrates a bottom view of fitted sheet 108 fitted to mattress 106. Along the bottom, fitted sheet 108 has an opening 302 having a banding of elastic 304 along a circumference of opening 302 in fitted sheet 108. Set back from banding of elastic 304 is a band of stretch fabric 306 along a perimeter thereof. The band of stretch fabric 306 is further connected to a perimeter of the fabric of fitted sheet 108. Thus, the fabric of fitted sheet 108 transitions to band of stretch fabric 306 to banding of elastic 304 along a perimeter of opening 302.

Band of stretch fabric 306, preferably but not restricted to a recycled stretch polyester or other material with strong elastane properties that recovers well, has been sewn in or attached all the way around the circumference of the fitted sheet 108 material. Instead of just lengthening the sheeting fabric which will not stay tight on the bed, this band of stretch fabric 306 added onto the fitted sheet 108 will pull taught any excess fitted sheet 108 fabric underneath the mattress 106 much better than just the traditional sewn in elastic band and will give the fitted sheet 108 the right amount of flexibility needs to cover different mattress depths.

In a preferred embodiment, the width of this band of stretch fabric 306 ideally would be approximately 3" to 7," however, it is readily appreciated more or less material can be used. In one preferred embodiment, if the band of stretch fabric 306 is too narrow, it will not have enough strength or length to add sufficient depth to cover the mattress 106 while pulling in the extra fitted sheet 108 fabric taught. If the band of stretch fabric 306 is too wide, it will make it hard to remove Bedding System 1 because the edge of the fitted sheet 108 will sit too far under the mattress 106 and a user won't be able to reach under the mattress 106 to remove Bedding System 1 off the mattress 106.

Banding of elastic 304 is disposed along the edge of band of stretch fabric 306. In one disclosed embodiment, banding of elastic 304 on fitted sheet 108 is approximately ½ inch to 1 inch rubber grip elastic 5 which is stronger than traditional elastic used on most conventional fitted sheets on the market. The rubber grips and elastic hold the fitted sheet 108 in place better vs. an encased or regular elastic usually found on regular fitted sheets. It is readily appreciated that other types of elastic can be used as needed.

The second component of Bedding System 2 may include the top sheet 110 as discussed above and illustrated, for example, in FIGS. 1B, 4A-6, 7A, 8A, 9A, 10 and 11.

Disclosed embodiments allow for the top sheet 110 to be unattached from the bottom fitted sheet 108 in all other places except across the foot of the bed 310 with open-ended zipper 116. Therefore, when the top sheet 110 is pulled up over the bed, a user's feet or lower limb portions are not enclosed or trapped in Bedding System 2 and can still hang over the foot of the bed 310, as is often the case for taller people. Also, many people stick their lower limbs out of the side of the sheets to cool off slightly. By having fitted sheet 108 and the top sheet 110 attached at open-ended separating zipper 116, the sheet system will remain intact if it is pulled on in any manner. There will be no more need for restless sleepers to get up in the middle of the night to readjust or re-tuck their sheets in.

Finally, Bedding System 2 is a preferred embodiment for the elderly, young, or people that use a duvet and have trouble lifting the mattress. This sheet system will remain on the bed in place during the entire duration of use because the band of stretch fabric 306 and banding of elastic 304 will keep the fitted sheet 108 in place, and because the sheets are zipped together the top sheet 110 will remain "tucked in." Hence the mattress 106 will not need to be lifted until there is assistance to help change and launder the sheet set. While this is a preferred embodiment, it is readily appreciated that the fitted and top sheet can be connected in other manners.

As seen in, at least FIGS. 1B, 4A-4C, 5, 6, 9A, 9B and 10, the length of the top sheet 110 has been increased by several inches, in this preferred embodiment, approximately 10 inches, compared to a regular standard top sheet to allow for the top sheet 110 to come up to the head edge of the bed and then fold over 502 the duvet top, for example, duvet cover 114, by 10" to 16". Should the top sheet 110 be lengthened more than this range, there would be too much sheeting fabric folded over and it would be hard to manage for sleepers. Should it be less, then there would not be enough to fold over adequately and then fasten to itself. While these are preferred embodiments, it is relatively appreciated that others can be used.

This fold over 502 is desired and necessary in order to improve and lengthen the longevity and cleanliness of the duvet cover 114, and also to give that clean polished look of the top sheet 110 sitting sharply and visibly on top of the duvet cover 114. Traditional top sheets are not long enough in the length to be able to tuck in at the foot 310 of the bed adequately so that it stays tucked in, while simultaneously being able to come up to the edge of the bed at the head and fold over sufficiently, approximately 10" to 15" back onto a traditional duvet cover.

A top portion of top sheet 110 may be folded at fold over 502. Thus, the top sheet 110 is connected together by a retaining device, such as at the snap 902, where the top sheet 110 will fold over onto itself and snap together. The preferred embodiment for this is a snap is a ball and socket snap (like a diaper snap) although it is readily appreciated other types of snaps can hold down the top sheeting fold over portion. This will help keep the top sheet 110 folded over and keep the duvet cover 114 and duvet insert 112 to remain covered during use.

A duvet insert 112 may be disposed and positioned on top of top sheet 110, generally between an area disposed between open-ended separating zipper 504. Duvet insert corner straps 506, otherwise known as duvet ties in some traditional duvet covers, may be disposed at corners of duvet insert 112. Duvet insert corner straps 506 may correspond at locations inside the top corners 508 of the top sheet 110 where the top sheet 110 folds onto itself at fold over 502 and secured/retained with snaps 902 for closure to connect the top sheet 110 to the duvet insert 112. These duvet insert corner straps 506 significantly help the duvet insert 112 stay in place. Using snaps instead of ties is a preferred embodiment, although others can be used, because it saves time for the users and will hold better than bulky ties which slip apart, that are found in traditional duvet covers.

Referencing FIGS. 1B, 4A-4C, and 5-11, in order to be able to integrate and attach the duvet cover 114, a open-ended separating zipper 504 is sewn from the head along one side of the top sheet 110, around the bottom and to the other side to the head of the bed. Therefore, the open-ended separating zipper 504 will go around three sides of the top sheet 110 leaving the head end open. Open-ended separating zipper 504 may sit on top of an overlapped fold of sheeting approximately 1" to 3" wide, that trims the fitted sheet 108 all the way around one side, across the bottom and up the other side. The overlap then hides, encloses, and separates open-ended separating zipper 504 from the sleeper therefore not allowing open-ended separating zipper 504 to rub on them.

Figure 6:
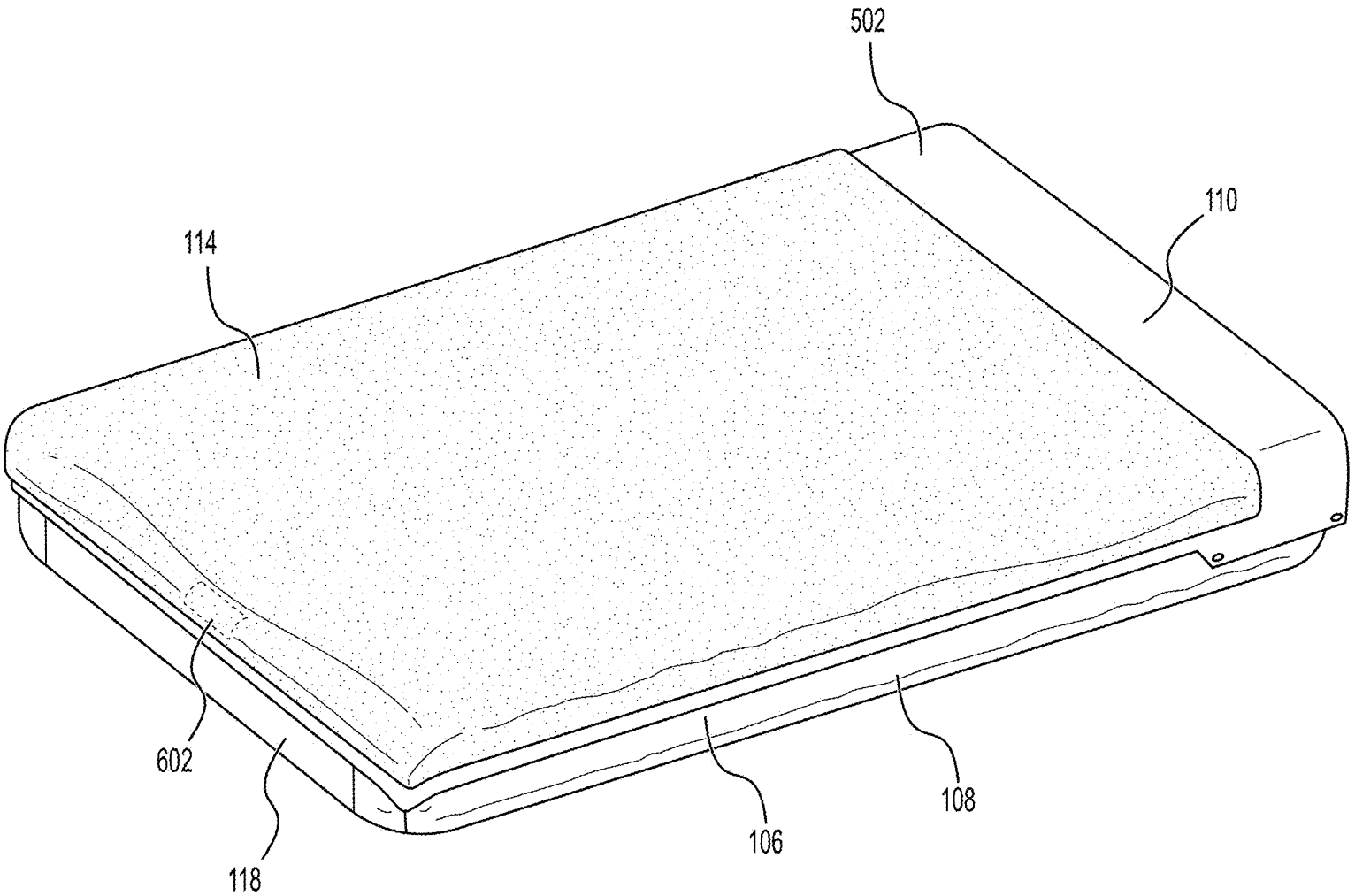
FIG. 6 is perspective view of a duvet cover disposed in an orientation with respect to a top sheet and a mattress fitted a fitted sheet according to one embodiment of the present disclosure.
Figure 7A:
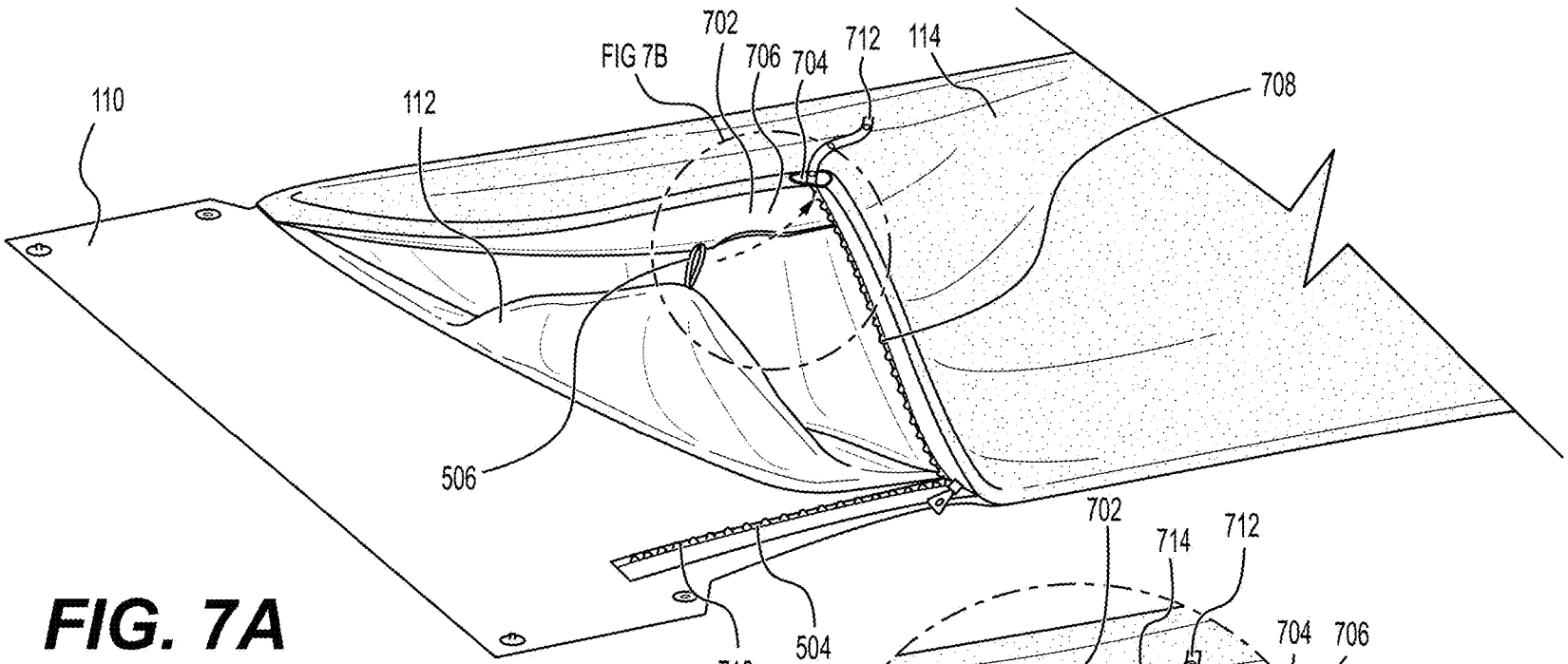
FIG. 7A illustrates a duvet insert fitted between a duvet cover and top sheet assembly according to one embodiment of the present disclosure.
Figure 7B:
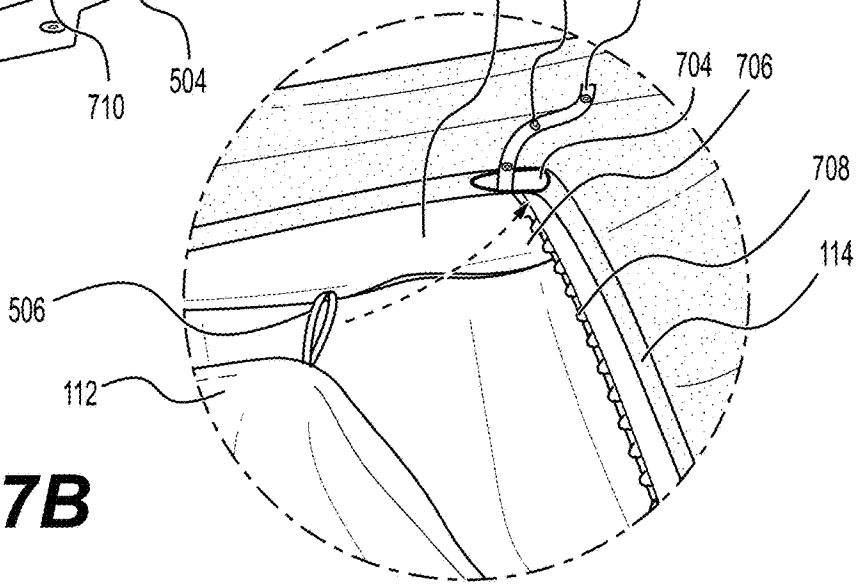
FIG. 7B illustrates an exploded view of FIG. 7A according to one embodiment of the present disclosure.
Figure 8A:
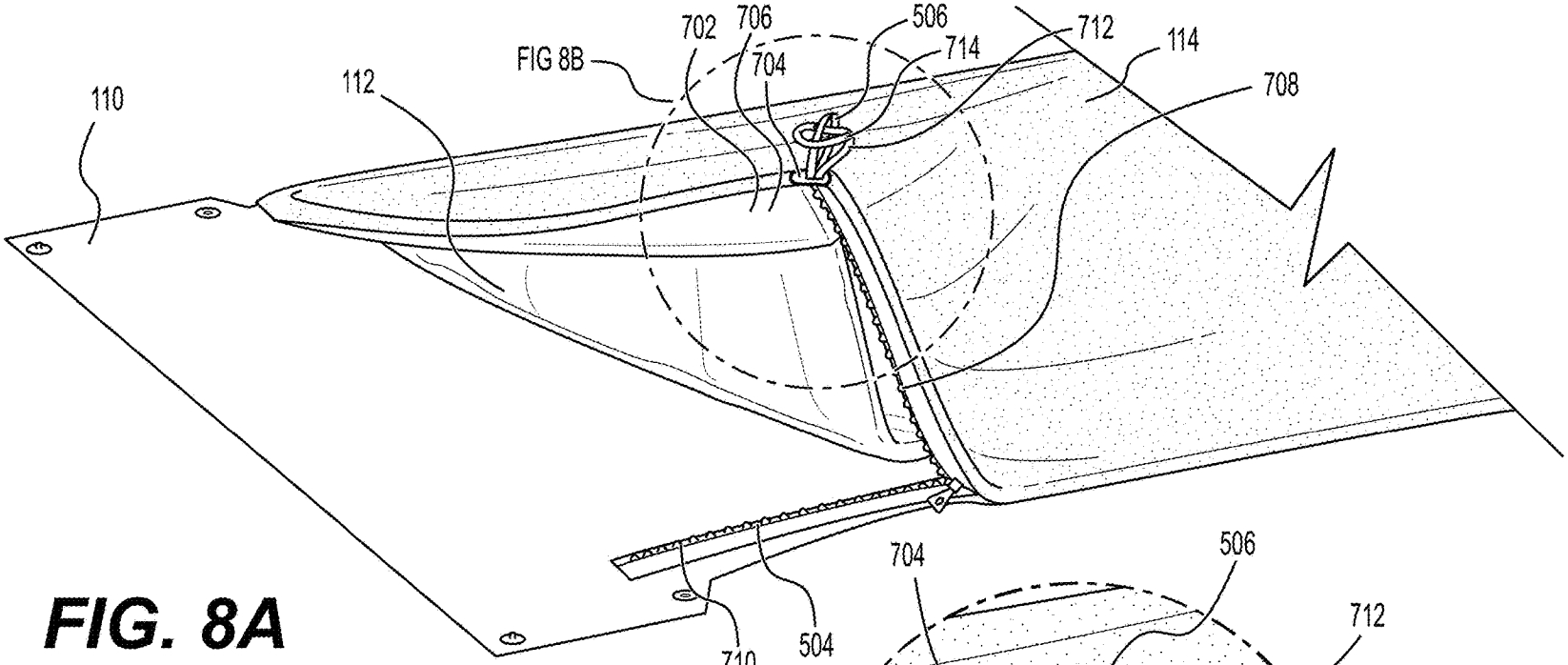
FIG. 8A illustrates a method of retaining a duvet insert to a duvet cover while disposed between a duvet cover and top sheet assembly according to one embodiment of the present disclosure.
Figure 8B:
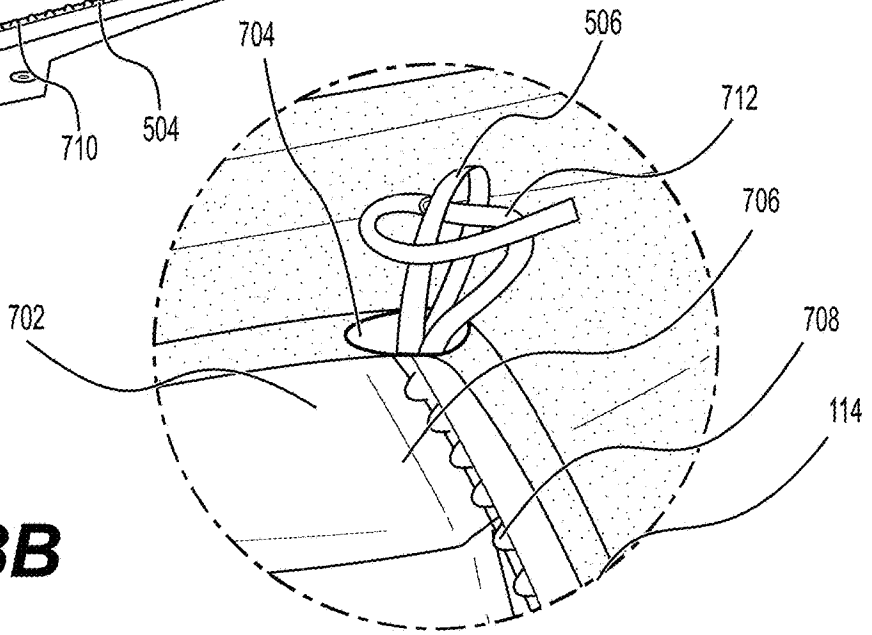
FIG. 8B illustrates an exploded view of FIG. 8A according to one embodiment of the present disclosure.
Figure 8C:
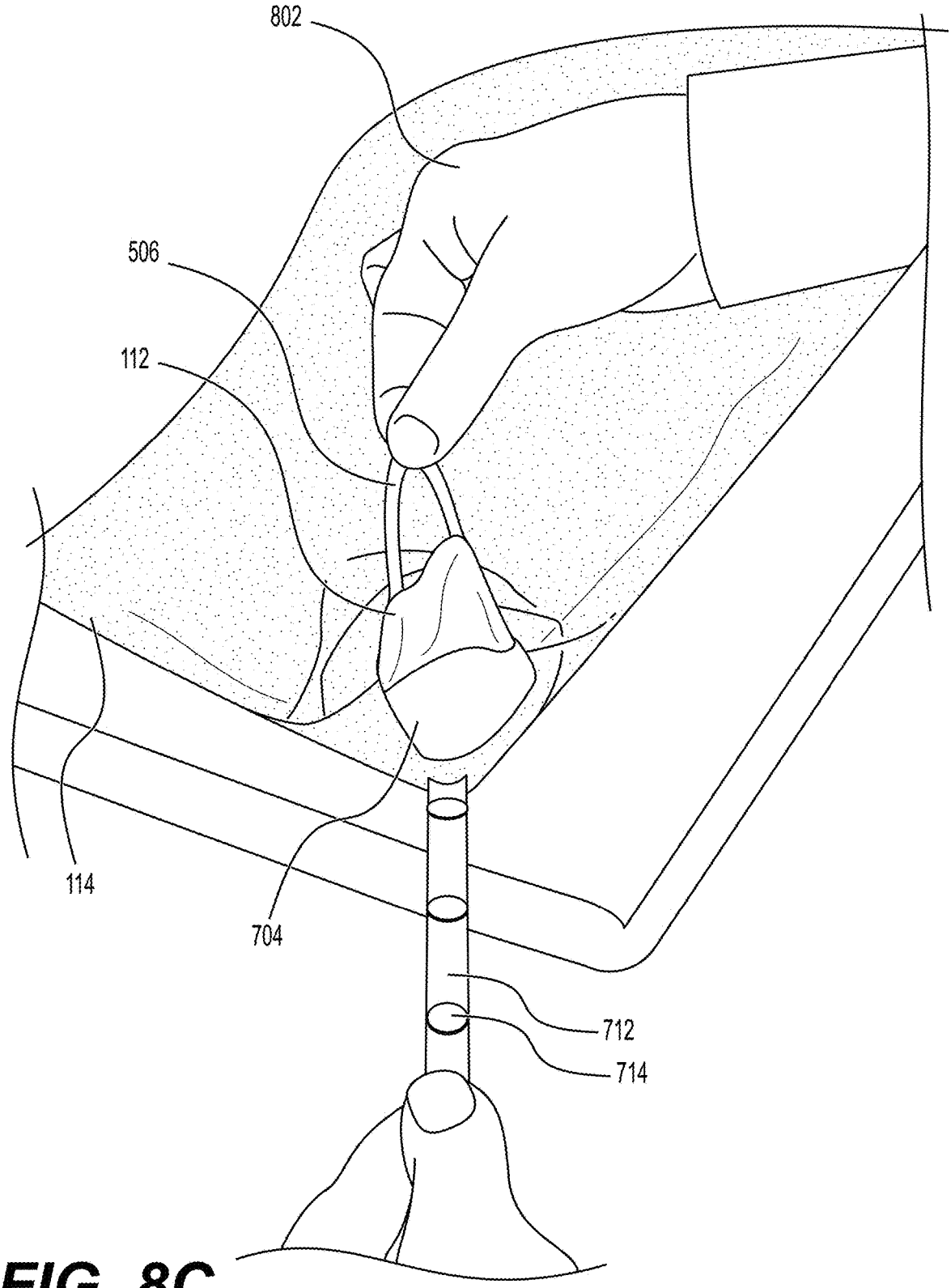
FIG. 8C further illustrates a beginning process of securing a duvet insert to a duvet cover at a prescribed location according to one embodiment of the present disclosure.
Figure 8D:
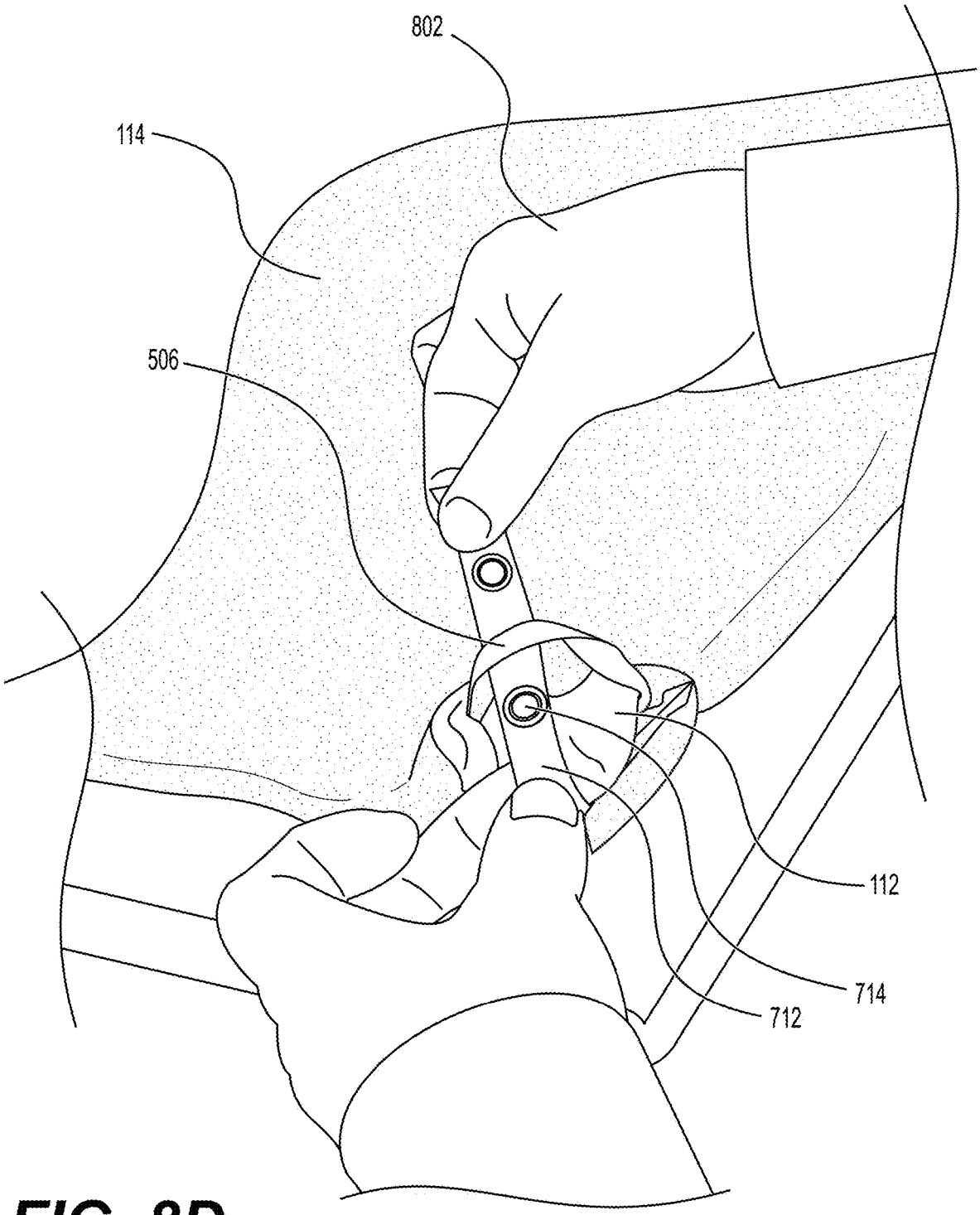
FIG. 8D further illustrates an intermediary process of securing a duvet insert to a duvet cover at a prescribed location according to one embodiment of the present disclosure.
Figure 8E:
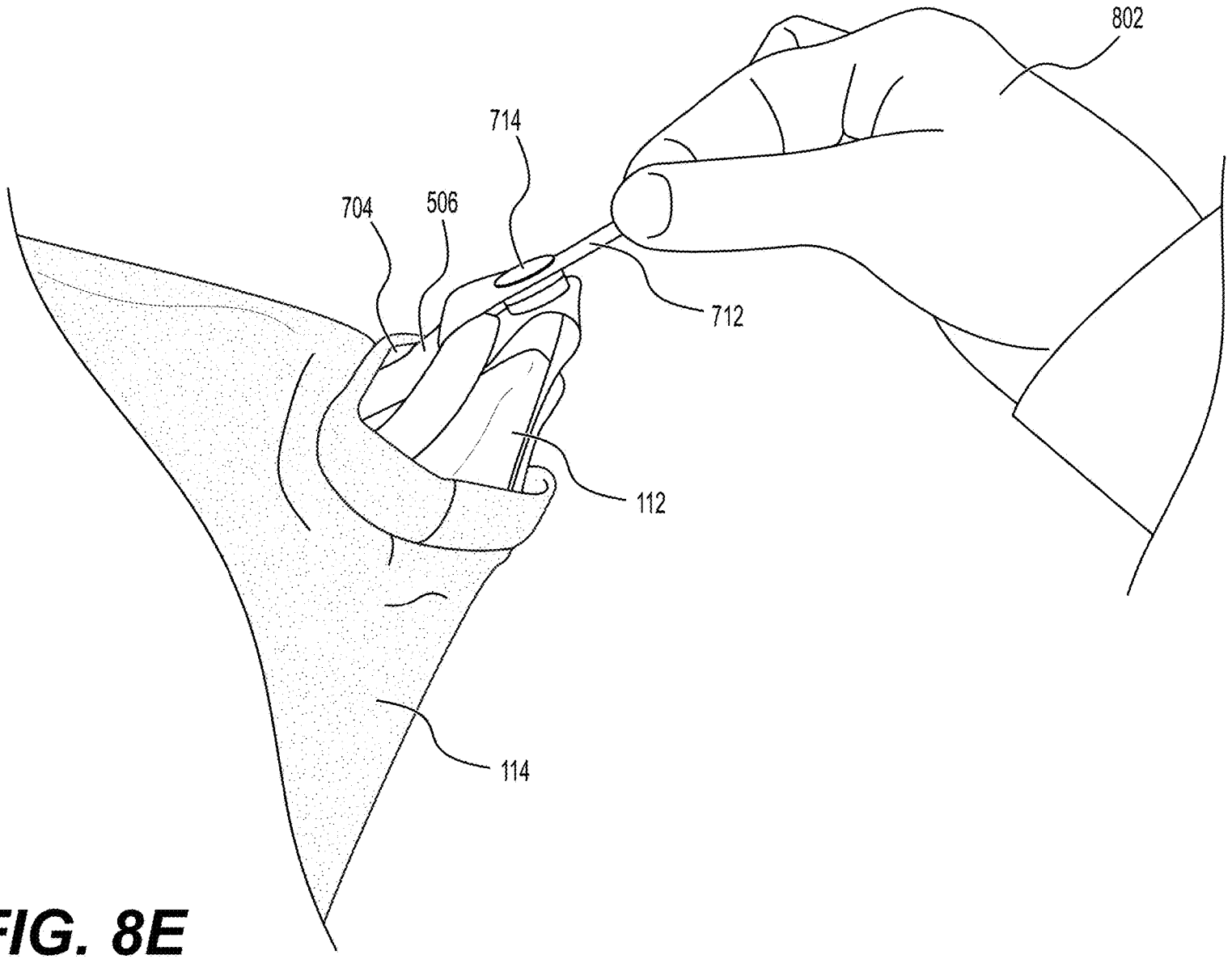
FIG. 8E further illustrates a final process of securing a duvet insert to a duvet cover at a prescribed location according to one embodiment of the present disclosure.
Figure 9A:
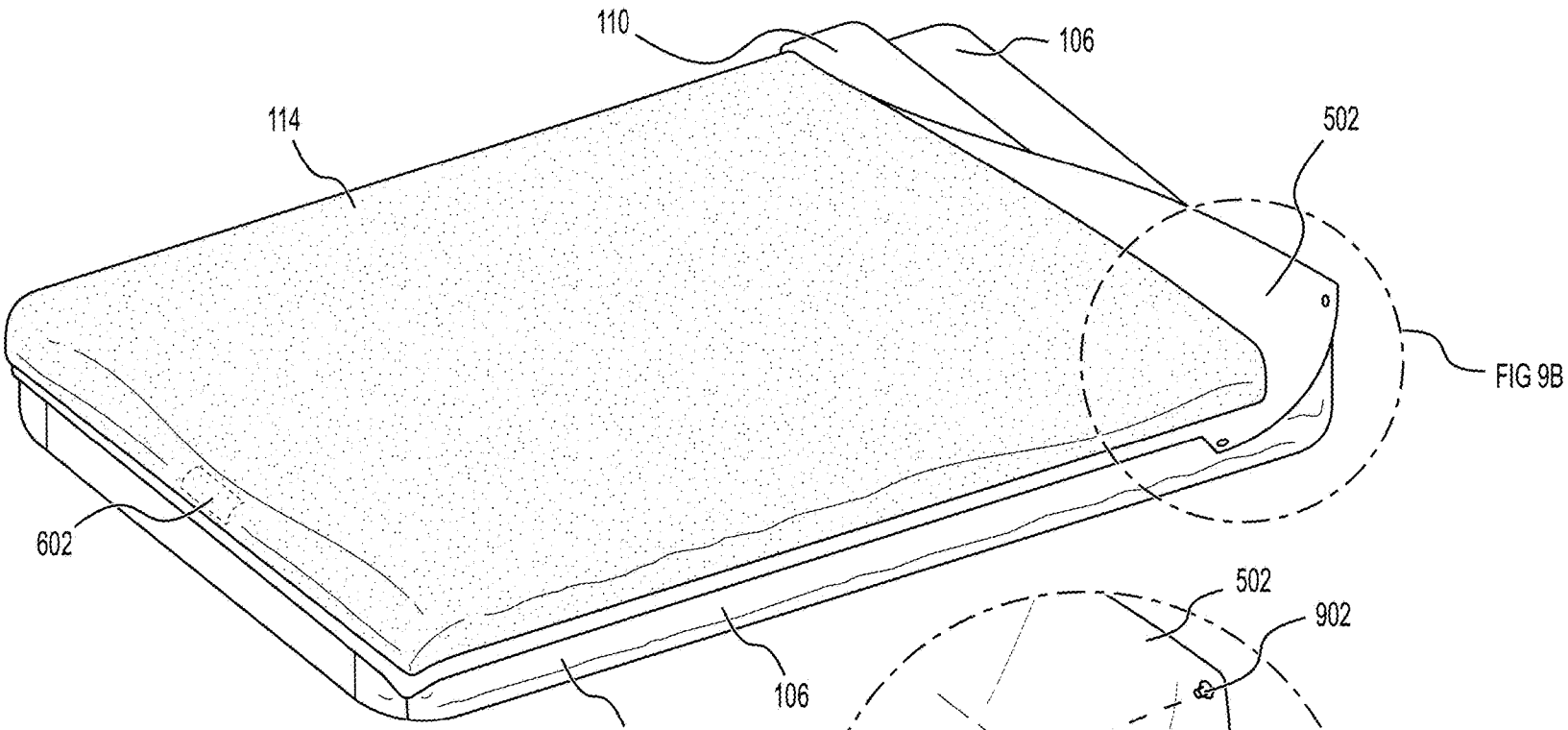
FIG. 9A illustrates an assembly of a duvet insert and duvet cover being retained by a fold down area of a top sheet according to one embodiment of the present disclosure.
Figure 9B:
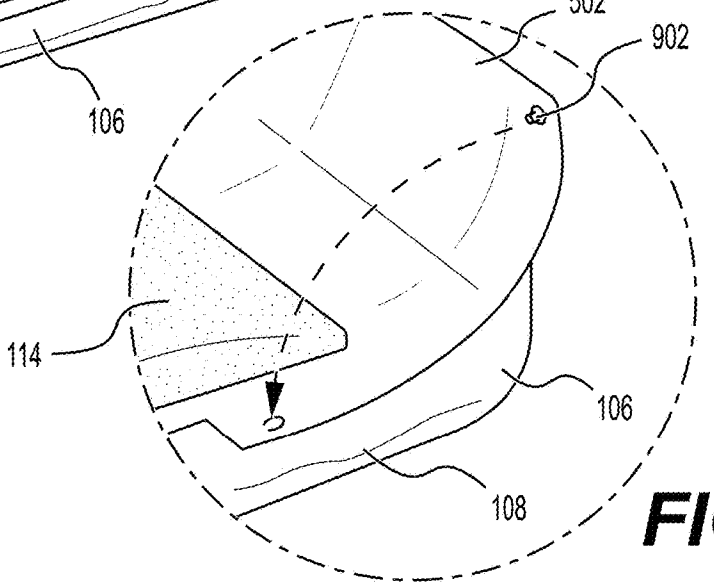
FIG. 9B illustrates an exploded view of FIG. 9A according to one embodiment of the present disclosure.

The duvet cover 114 is a piece of fabric or material that will cover the top of the duvet insert 112, as illustrated in FIG. 6. In some embodiments, as shown in FIGS. 7A and 7B, the head of the duvet cover 114, there is an approximate 12" cover fold 702 over of fabric or material in which the head end of the duvet insert 112 will be placed between. This is an optimal length of cover fold 702 because if the cover fold 702 is too small (e.g., under 8") the cover fold 702 may not be effective and may not stay in place. If the cover fold 702 is too long (e.g., greater than 16") it may make it difficult to insert the duvet insert 112. While this is a preferred embodiment, it is recognized that more or less can be used as needed. The purpose of the duvet cover 114 cover fold 702 is to protect the head end of the duvet insert 112 and to not expose sleepers directly to the duvet insert 112 in case the top sheet 110 is pulled back which would not be hygienic over time.

In the corners of the duvet cover 114 will be two open hand holes 704, approximately 4" to 8" wide as shown in FIGS. 7A, 7B, 8A, 8B. These hand holes 704 will facilitate pulling the duvet insert 112 up to the top corners of the duvet cover 114. The hand holes 704 allow users to reach through them to access duvet insert 112. A user is then able to pull the duvet insert 112 up and snug into the cover fold 702.

The hand holes 704 will also facilitate the user to connect the duvet cover 114 to the duvet insert 112. As seen in FIGS. 7A, 7B, and 8A-8E on the inside of the duvet top corners of the duvet cover 114 are attached duvet cover corner straps 712. A user 802 may access duvet insert corner straps 506 through hand holes 704. Duvet cover corner straps 712 may be provided at prescribed location such at corresponding inside top corners of duvet cover 114. Duvet cover corner straps 712 may connect the duvet cover 114 to the duvet insert 112 by fishing duvet cover corner straps 712 through loops formed by duvet insert corner straps 506 and securing the same as described below. Securing duvet insert corner straps 506 may include snapping duvet cover corner straps 712 together, onto itself, once inserted and looped through duvet inert corner strap 506 loops. Once secured, a user may push the connected duvet cover corner straps 712 and duvet insert corner straps 506 back through the hand hole 704 to hide the connection and present an aesthetically pleasing arrangement of the disclosed sheet assembly. In the disclosed connected arrangement, duvet insert 112 is thereby prevented from slipping down or out of place from duvet cover 114 during use.

Additional duvet cover corner straps 712 may also be located in the bottom corners of the duvet cover 114 to secure the bottom of the duvet insert 112 to the duvet cover 114 such as through additionally corresponding mating duvet insert corner straps 506 of duvet insert 112. Once again, these duvet cover corner straps 712 are to be looped through the duvet straps 506 and snapped together. Duvet cover corner straps 712 will prevent the duvet insert 112 from moving out of place at the foot of the bed 310.

Figure 10:
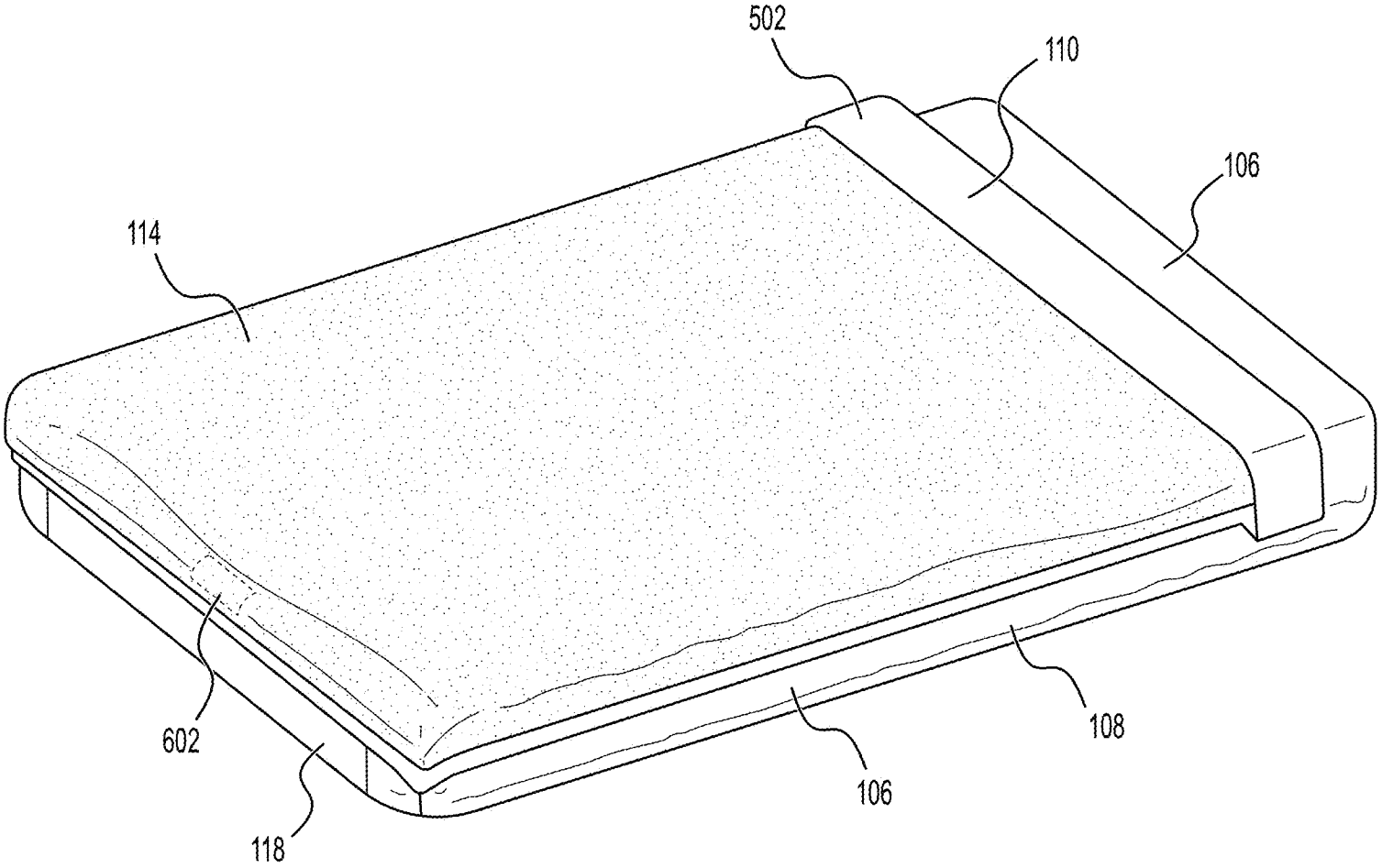
FIG. 10 illustrates a final assembly of bed sheet system according to one embodiment of the present disclosure.
Figure 11:
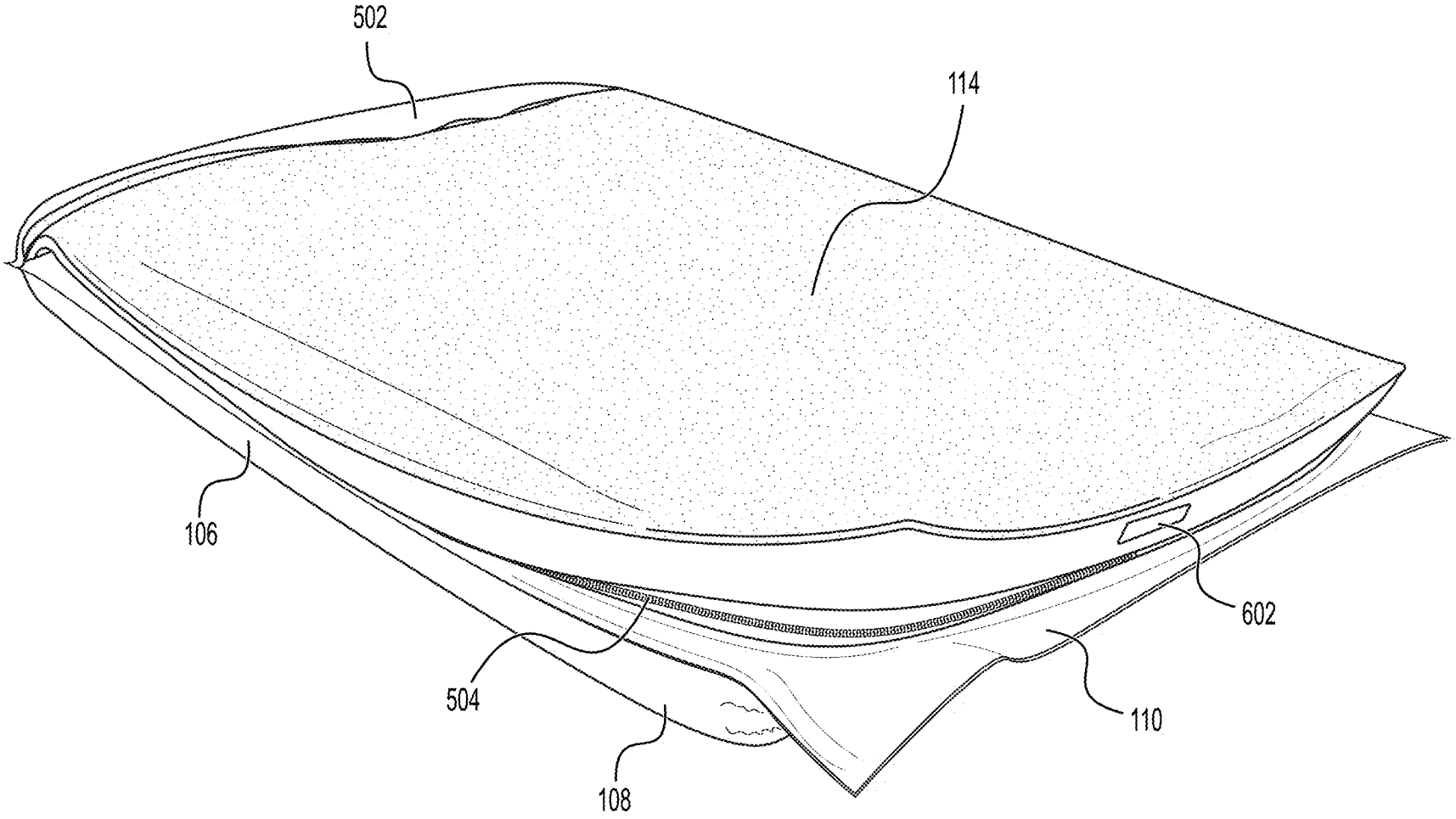
FIG. 11 illustrates an aesthetic perspective view of a bed sheet system assembly according to one embodiment of the present disclosure.

Along the sides and bottom of the duvet cover 114 is the other side of the open-ended separating zipper 504, that matches with the other portion of open-ended separating zipper 504 that has been sewn onto the top surface of top sheet 110. The duvet cover 114 fabric will extend from the side edge of the duvet cover 114 to approximately 3" to 7" underneath the duvet cover 114 in order to hide the duvet insert 112 and have a nice soft looking edge to the bedding as illustrated in FIGS. 10 and 11. The duvet cover 114 will also extend from the foot edge of the duvet cover 114 to approximately 6" to 12" up under the duvet cover 114. This will enclose the duvet insert 112 into the duvet cover 114 at the foot and will hide the open-ended separating zipper 504 from the end. The open-ended separating zipper 504 will ensure that the duvet cover 114 is attached securely to the top sheet 110 and that the duvet cover 114, the duvet insert 112 and top sheet 110 will move in tandem. Also, within Bedding System 2, the duvet insert 112 will remain securely in place between the two layers of fabric.

Keeping Bedding System 2 on and in place during use is much easier than a traditional set of sheets and a traditional duvet and cover. First, the fitted sheet 108, will remain on the mattress because of its innovative elastane band of stretch fabric 306 and approximately ½ to 1 inch band of elastic 304 with gripping rubber. The top sheet 110 will not be displaced at the foot of the bed, because it is attached to the fitted sheet 108 with the connecting panels 118 and extending fabric 404 via open-ended zipper 116. Also, the top sheet 110 and the duvet insert 112 and duvet cover 114 will move in tandem because of the zippered sides which connect the two layers of fabric and the duvet straps hold the duvet insert 112 in place.

The installation of Bedding System 2 on a mattress 106 is unique and differs from traditional bedding sets, however, is similar to that of Bedding System 1 as described above. The order of placing the layers of fabric and insert on the bed follows the order of the layers from bottom to top in FIG. 1B. On the fitted sheet 108, a navigation patch 122 has been sewn on or attached visibly onto the connecting panel 118 to clearly mark where the foot of the fitted sheet 108 is. The navigation patch 122 is on the inside of the connecting panel 118 when the connecting panel 118 is zipped. Therefore, only the stitch marks are visible. Users who are making the bed or putting on the sheets will first locate the navigation patch 122 on the fitted sheet 108 and place it onto the foot of the mattress 106 and around the corners. Once complete, the users will migrate to the head of the bed and place the fitted sheet 108 onto the mattress 106 at the top corners. The navigation patch 122 guides users in the orientation of the bedding system so one will never put on the bedding and subsequently find out you have it oriented the wrong way.

Next, users will locate a navigation patch 122 sewn on the foot end 402 of the top sheet 110 as shown, for instance, in FIGS. 4A-4C. With this navigation patch 122 facing up and toward the user, they will lay it out on the mattress 106 and then zip it to the fitted sheet 108 via the connecting panels 118 and extending fabric 404 and open-ended zipper 116.

Once users have the fitted sheet 108 and top sheet 110 on the mattress 106 and zipped together, the user will place their duvet insert 112 on top of the sheet 110, as shown in FIG. 5. The duvet insert 112 should be placed centrally width wise on the mattress 106 and pulled down a few inches (approx. 4") from the head of the bed. Pulling the duvet insert 112 down a few inches will allow the sleeper to not have the duvet insert 112 pulled up too high, hence covering their head when they sleep.

Referencing FIGS. 1B, 6, 7A, 8A-8E, 9A, 10 and 11, once the duvet insert 602 is on the bed, the user finds the navigation patch 122 on the underside of the duvet cover 114 and will lay it with the zipper side down on top of the duvet insert 112. They will pull the duvet insert 112 up and inside the cover panel 702 at the head of the duvet cover 114 by reaching through the duvet top hand holes 704 and pull the duvet insert 112 up.

After the duvet insert 112 is in place at the head end of the duvet cover 114, the user will attach the duvet cover corner straps 712 through duvet insert corner straps 506 of the duvet insert 112 such as via user 802 access through hand holes 704 of the duvet cover 114 of duvet insert 112. Duvet insert corner straps 506 may be secured to duvet cover 114 by inserting and looping duvet cover corner straps 712 through duvet insert corner straps 506. Once inserted therethrough, duvet cover corner straps 712 may be folded back over onto itself and snapped together to provide a secure connection between duvet cover corner straps 712 and duvet insert corner straps 506. The aforementioned connection thereby securely connects duvet insert 112 to duvet cover 114. Disclosed embodiments may further include providing duvet cover corner straps 712 in the bottom corners of the duvet cover 114. Duvet cover corner straps 712 may be attached directly to the duvet corner straps 506 disposed at similar locations as well, such as via snaps as described earlier.

The user will zip up or secure the open-ended separating zipper 504 around the 3 sides of the duvet cover 114 and the top sheet 110 to enclose the duvet insert 112 in between the top sheet 110 and the duvet cover 114. The last step is to pull over the extra top sheet 110 portion back over the duvet cover 114 and secure side snaps 902 to create a secure and neat presentation.

To remove the duvet cover 114, duvet insert 112 and top sheet 110 and fitted sheet 108, the user would unzip the open-ended separating zipper 504 around the three sides, separate the duvet cover corner straps 712, and the duvet cover 114 is one in itself again. Subsequently the user would remove the duvet insert 112, unzip the top sheet 110 from the fitted sheet 108, and the top sheet 110 is separate. Finally, remove the four corners of the fitted sheet 108 portion off the mattress 106. After doing this, all four components of Bedding System 2, the duvet cover 114, the duvet insert 112, and the top sheet 110 and fitted sheet 108 are separated again.

The use of the innovative Bedding System 2 has many benefits. First of all, by integrating the components that can be attached into one, the sheet set, and duvet insert 112, and duvet cover 114 will stay in place ensuring the sleeper is not affected by displaced sheets at the foot 310 of the bed, and thus has a better night's sleep. The simplicity of the duvet cover 114 offers many benefits. First, it is much easier to place on the duvet insert 112 and duvet cover 114 eliminating the need for tucking, rolling, shaking, and climbing into the traditional duvet cover. Also, the top sheet 110 will remain tucked and pulled up so it will not be displaced either. With the duvet cover 114 being easy to install and remove, users can change their bedding esthetics easily, launder their sheet set and duvet cover 114 easier and more often, and install it much easier and quicker.

Also, while the Bedding System 2 is on the bed, users can make the bed or reposition it back to its original position effortlessly. This system eliminates the step of fixing the top sheet 110 first and then straightening and centering their duvet insert 112 and duvet cover 114. All users including the young, the old and those with mobility problems will be able to make their bed easier, relieving stress and angst in the morning, and less reliance upon those related parties that are helping with making the bed and lift their mattress 106. Finally, for those that sleep with their pets or change their beds often, including rental homes such as Airbnb's and the like, this system will save them much time and heartache that the traditional bedding systems inflicts on users and launderers.

Many users of traditional bed sheets find the fitted sheet especially hard to fold because of the shape of the sheet and the elastic banding. Bedding System 1 also has a fitted sheet 108 component which users may find it challenging to fold as well. Therefore, users will have the option of using the associated Bed Sheet Folding Board 1200 as shown in FIGS. 12-18 and described within this document for easy folding and neat storage.

Folding the duvet cover 114 is the same process as folding a traditional top sheet. Next is folding the top sheet and fitted sheet. The first step to fold Bedding System 2 is to place the top sheet 110 on top of a flat surface, for example your bed. Next, place the fitted sheet 108 upside down so the elastic portions of the fitted sheet 108 are facing up as seen in FIG. 13. Ensure the top sheet 110 is pulled completely out and flat on the surface, and the fitted sheet 108 likewise. Place the folding board 1200 inside the end of the fitted sheet 108 and fold into the board the end of the top sheet 110 that is hanging closest to you. Once complete, fold in the long sides of the top sheet 110 towards the center so the sheet set is as wide as the board 1200 as FIG. 14 illustrates. As shown in FIG. 15, flip over the folding board 1200, rotating the long end of the board that is closest to you over, working your way to the end of the top sheet 110 and fitted sheet 108 until a full turn is not possible. Fold in the short remaining portion of the top sheet 110 once there is not a full turn of sheeting to be made. Finally, fold in the outside panels of the board 1200 into the middle so it makes a compact cuboid shape (e.g., see FIG. 17). One can place the Sheet Band 1802, while preferred but not necessary, around the sheet set to store as illustrated in FIG. 18. The sheet band 1802 will keep the folded sheets and board 1200, which is folded into the sheet set, together while indicating the size of sheet (Twin, Queen, King) that has been folded for future use. While the folding board 1200 is a preferred embodiment and process of folding Bedding System 2, it is readily appreciated that other methods of folding sheets can also be used.

Bed Sheet Folding Device

When it comes to folding a set of bed sheets, many have difficulty because of their size and shape. Folding a top sheet is relatively straight forward, yet cumbersome due to the size of the sheet, because it is a rectangle that can be folded in half many times lengthwise and crosswise which results in a compact cuboid shape. A fitted sheet is more difficult to fold because of the fitted or tightening properties and elastic around the edge of the sheet which makes it impossible to flatten out completely.

Using the Sheet Folding Board 1200 as shown in FIGS. 12-18 will be described hereafter and will alleviate many of the problems people experience when folding bed sheets. First, users will not have to strain, shake, or stretch when they fold sheets because the sheets will be sitting on a flat surface throughout the process. Secondly, all similar sizes of bed sheets will be easily stackable in or on a storage area because they will all fold tightly and neatly into an equivalent size fitted cuboid shape. Finally, it will save users time because both sheets are being folded at the same time vs. one sheet and then the other.

This folding board 1200 has 7 sections made of 4 different sizes as shown in FIG. 12 which are shown separated by hinges, attachments, routered edges, seams, or any other type of fastener or movable bend which connects the panels that can allow the panel pieces to swing 360 degrees, or 180 degrees either way. It is especially important that the panels can swing 180 degrees either way because when you are rotating the board over and over to fold up the sheets as discussed hereafter, the user cannot determine which way the board is facing when they are finished turning. Therefore, when you are finished turning, the side panels can be folded into the board if you have either side up after the last turn.

The design of the Sheet Folding Board 1200 has a line of stitches on the cork fabric which encases a hard waterproof piece of material to separate its sections. This embodiment uses fabric with sections sewn in to separate the sections, because if one uses hinges made of metal or any other type of material that may be sharp, they may rip the sheets being folded. Also, cork fabric is used in this embodiment because it is moisture resistant and is hypoallergenic, therefore safe to use while folding and storing sheets. Another alternate way to make this board 1200 is to create it out of plastic or some other formable material, either in several pieces or as one long piece, and the sections would be able to move 180 degrees each way. While these are preferred embodiments, it is readily appreciated that other embodiments can be used as needed The total width of this folding device for Queen bed linens is optimal in the 50" to 55" width but is not limited to this range. These are preferred embodiments, however it is appreciated that more or less can be used as needed, because Queen bed fitted sheets are typically 60 inches wide, and a board wider than this will not be able to be enclosed in the fitted sheet easily. A board width narrower than this would not suffice either because there would be too much excess sheeting that would have to fold into the middle. This therefore would impair the board to be folded into a squared cuboid shape. The optimal ranges for a King board would be approximately 55" 65" and a Twin board would be approximately 25" to 35", for the same reasons as mentioned for the Queen board, however, the Twin board would only have 3 sections due to its size limits. The board widths are generally approximately 5" to 15" less than the widths of the mattress widths.

The width of each of the device sections will vary based on where they lie within the device. Panels, the outside panel pieces, will be slightly narrower (1" to 3") than the $3^{rd}$ and $5^{th}$ panel pieces. This is to facilitate the folding in of the board and to allow the excess fabric on the ends of the board to fit into the fold. The $2^{nd}$ and $6^{th}$ panels from the end of the board will be approximately 1" to 2" in width to allow pieces 1 and 3 and 5 and 7 to fold in onto itself. Finally, piece 4 in the middle of the board will be the flat closed edge of the board once folded up. It will be slightly larger than the sum of the width of boards 2 and 6. This piece needs to be bigger than the sum of 2 and 6 because when folded in, 2 and 6 together form the opposite side of panel 4. If the panel piece(s) total the same size, when folding in the panels, the bulk of the sheet material will force the size of panel 2 and 6 to be larger than size 4 and thus not make a cuboid structure. If it is slightly smaller, the excess fabric can be accommodated in the fold and can still make a perfect cuboid. These are preferred embodiments for the reasons mentioned above, however, it is readily appreciated that more or less can be used as needed.

The length of each panel is the same length from top to bottom. This is because when the device is used and folded up, all sections of the device, and subsequently the sheeting material wrapped around it, will be the same length to make a cuboid shape. The length of the panels or sections of this device works best if it lies in the range of approximately, 10" to 18" but is not restricted to this size. If the panel sections are too long, then when the sheeting material is folded in and the device is folded into a cuboid shape, the cuboid will be exceptionally large and will be hard to store in a linen closet, drawer, or other storage place. If the panels or sections of the device are too short, the user will have to roll or flip it over lengthwise many more times than a longer board to wrap the sheeting material around it. Then the user will have difficulty folding the device into a cuboid shape. While this is a preferred embodiment, it is readily appreciated that more or less length can be used as needed.

The first step to fold Bedding System 1 or Bedding System 2, or even a regular sheet set, is to place it on top of a flat surface, for example your bed, upside down so the top sheet is on the bottom and the elastic portion of the fitted sheet is facing up. Ensure the top sheet 110 is completely pulled out and flat on the surface, and the fitted sheet 108 likewise. As seen, place the Sheet Folding Board 1200 inside the end of the fitted sheet 108 and fold up the side end of the fitted sheet to cover the board 1200. Once complete, fold in the long sides of the top sheet 110 or traditional top sheet towards each other so the sheet system or sheet set is as wide as the board 1200. Flip over the folding board 1200, rotating the end of the board 1200 that is closest to you over, working your way to the end of the flat or traditional flat sheet and fitted sheet 108 until most of the sheeting material encircles the board 1200 and one full roll cannot be made. Fold down the short remaining portion of the top sheet 110 once there is not a full turn to be made. Finally, fold in the outside panels of the board 1200 to the middle and once again for panels and once again so it makes a compact cuboid shape. A user can place an optional Sheet Band 1802 or elastic banding material around the sheet set or store it as is without the band. The Sheet Band 1802 is an elastic approximately 1" wide and approx. 24" long which has a band logo on it and the size of the sheet set to be folded (Twin, Queen, King). The sheet band 1802 will keep the folded sheets and board together while indicating the size of sheet that has been folded for future use.

Having described the many embodiments of the present invention in detail, it will be apparent that modifications and variations are possible without departing from the scope of the invention defined in the appended claims. Furthermore, it should be appreciated that all examples in the present disclosure, while illustrating many embodiments of the invention, are provided as non-limiting examples and are, therefore, not to be taken as limiting the various aspects so illustrated.

All documents, patents, journal articles and other materials cited in the present application are incorporated herein by reference.

While the present invention has been disclosed with references to certain embodiments, numerous modification, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A bed sheet system comprising:

a fitted sheet configured to fit over a mattress, wherein the fitted sheet comprises a first connecting panel;

a top sheet configured to fit over the fitted sheet, wherein the top sheet comprises a second connecting panel;

a duvet cover, wherein the duvet cover includes an open-ended separating zipper along a bottom surface configured to traverse sides and a bottom of the bottom surface of the duvet cover generally along a perimeter thereof; and a duvet insert, wherein the duvet insert is received between the top sheet and duvet cover during assembly, wherein the first connecting panel and the second connecting panel comprise an open-ended zipper assembly that zips together to connect the first connecting panel together with the second connecting panel, wherein the top sheet includes an open-ended separating zipper along a top surface of the top sheet, wherein the open-ended separating zipper is configured to traverse sides and a bottom of the top surface of the top sheet generally along a perimeter thereof, wherein the top sheet is configured to connect to the duvet cover via the open-ended separating zipper in an assembly, wherein the duvet insert is configured to attach to the duvet cover, wherein the duvet insert includes straps, wherein the duvet cover includes holes for receiving the straps therethrough, wherein the top sheet includes a fold over portion generally disposed at a top of the top sheet, wherein the fold over portion includes snaps for retaining the fold over portion together, wherein the straps are disposed at and retained by the snaps.

2. The bed sheet system of claim 1, wherein the first connecting panel and the second connecting panel are disposed at a foot of the mattress.

3. The bed sheet system of claim 1, wherein the first connecting panel and the second connecting panel each include navigation patches that are matched together during assembly to properly orient the fitted sheet with respect to the top sheet.

4. The bed sheet system of claim 1, wherein the navigation patches of the first connecting panel and the second connecting panel are configured to the fitted sheet and the top sheet, respectively, generally at a foot of the mattress.

5. The bed sheet system of claim 1, wherein the fitted sheet comprises:

an opening for receiving the mattress;

a band of elastic material configured to traverse around a perimeter of the opening;

a band of stretch fabric material configured and attached to the band of elastic material, wherein the band of stretch fabric transitions and is further connected to a remaining material of the fitted sheet.

6. The bed sheet system of claim 5, wherein the band of stretch fabric material comprises stretch polyester having a width of approximately 3-7 inches.

7. The bed sheet system of claim 5, wherein the band of elastic material comprises an approximately ½-1 inch width rubber grip elastic.

8. The bed sheet system of claim 1, wherein the top sheet includes a fold over portion generally disposed at a top of the top sheet, wherein the fold over portion includes a retainer for retaining the fold over portion together when folded.

9. The bed sheet system of claim 8, wherein the retainer includes snaps.

10. The bed sheet system of claim 1, wherein the duvet cover includes folded areas for receiving portions of the duvet insert along a bottom surface of the duvet cover.

11. The bed sheet system of claim 1, wherein the duvet cover includes a navigation patch at a disposed position, wherein the duvet cover is oriented by matching the navigation patch of the duvet cover with the navigation patches of the fitted sheet and the top sheet to properly orient the duvet cover with respect to the fitted sheet and the top sheet.

* * * * *